US011910925B2

(12) United States Patent
Grossman et al.

(10) Patent No.: US 11,910,925 B2
(45) Date of Patent: Feb. 27, 2024

(54) FURNITURE OBJECTS INCLUDING HIDDEN CONTAINERS

(71) Applicant: Night and Day Furniture LLC, Vancouver, WA (US)

(72) Inventors: Joel Grossman, Petaling Jaya (MY); Howard Porter, Kuala Lumpur (MY)

(73) Assignee: Night and Day Furniture LLC, Vancouver, WA (US)

( * ) Notice: Subject to any disclaimer, the term of this patent is extended or adjusted under 35 U.S.C. 154(b) by 0 days.

(21) Appl. No.: 17/473,262

(22) Filed: Sep. 13, 2021

(65) Prior Publication Data

US 2021/0401173 A1 Dec. 30, 2021

Related U.S. Application Data

(62) Division of application No. 16/374,947, filed on Apr. 4, 2019, now Pat. No. 11,178,966.

(51) Int. Cl.
*A47B 96/20* (2006.01)
*A47B 88/90* (2017.01)

(52) U.S. Cl.
CPC ..... *A47B 88/90* (2017.01); *A47B 96/20* (2013.01); *A47B 2210/08* (2013.01); *A47B 2210/16* (2013.01)

(58) Field of Classification Search
CPC ..... A47B 88/90; A47B 96/20; A47B 2210/08; A47B 2210/16
See application file for complete search history.

(56) References Cited

U.S. PATENT DOCUMENTS

| | | | |
|---|---|---|---|
| 162,267 | A | 4/1875 | Bleyley |
| 317,355 | A | 5/1885 | Shannon |
| 331,163 | A | 11/1885 | Shannon |
| 375,574 | A | 12/1887 | Shannon |
| 524,225 | A | 8/1894 | Smith |
| 917,429 | A | 4/1909 | Green |
| 1,147,998 | A | 7/1915 | Anderson |
| 2,174,582 | A | 10/1939 | Blanche |
| 2,492,697 | A | 12/1949 | Higley |
| 3,332,729 | A | 7/1967 | Dickson |
| 3,456,996 | A | 7/1969 | Heiniger-Schar |
| 3,572,873 | A | 3/1971 | Harting, Jr. |
| 3,806,220 | A | 4/1974 | Payne |
| 4,113,332 | A | 9/1978 | McMaster |
| 4,252,387 | A | 2/1981 | Wagner |
| 4,632,472 | A | 12/1986 | Bross |
| 5,048,901 | A | 9/1991 | DeBlaay |
| 5,230,551 | A | 7/1993 | Kramer |
| 5,704,095 | A | 1/1998 | Guenschel |

(Continued)

*Primary Examiner* — James O Hansen
(74) *Attorney, Agent, or Firm* — Harness, Dickey & Pierce, P.L.C.

(57) ABSTRACT

A furniture apparatus including a frame, a movable facade configured to transition between an open state and a closed state; and a hidden container configured to rest on a set of support ledges attached to one or more of the frame and an unhidden container optionally associated with the furniture apparatus such that the hidden container is configured to be visible when the movable facade is in the open state, and the hidden container is configured to be hidden from view when the hidden container is installed in the furniture apparatus and the movable facade is in the closed state.

12 Claims, 21 Drawing Sheets

(56) References Cited

U.S. PATENT DOCUMENTS

| | | | | |
|---|---|---|---|---|
| 5,727,291 | A | 3/1998 | Biondo et al. | |
| 5,944,396 | A | 8/1999 | Stephan | |
| 6,199,816 | B1 * | 3/2001 | Case | A47B 23/042 248/460 |
| 7,762,636 | B2 | 7/2010 | Veeser et al. | |
| 9,173,488 | B1 | 11/2015 | Bello | |
| 9,526,335 | B2 | 12/2016 | Grossman et al. | |
| 2005/0264141 | A1 | 12/2005 | Whitall | |
| 2007/0216269 | A1 | 9/2007 | Kischitz | |
| 2008/0036343 | A1 | 2/2008 | Wang | |
| 2008/0211362 | A1 | 9/2008 | Moll et al. | |
| 2009/0230826 | A1 | 9/2009 | Myers | |
| 2010/0066221 | A1 * | 3/2010 | Hakemann | E05C 3/124 49/489.1 |
| 2010/0079043 | A1 | 4/2010 | Stefka | |
| 2011/0012481 | A1 | 1/2011 | Becker et al. | |
| 2015/0070867 | A1 | 3/2015 | Head | |
| 2016/0037920 | A1 * | 2/2016 | Grossman | A47B 88/80 312/204 |
| 2016/0166072 | A1 | 6/2016 | Edwards | |
| 2017/0150813 | A1 * | 6/2017 | Stares | A47B 67/04 |

* cited by examiner

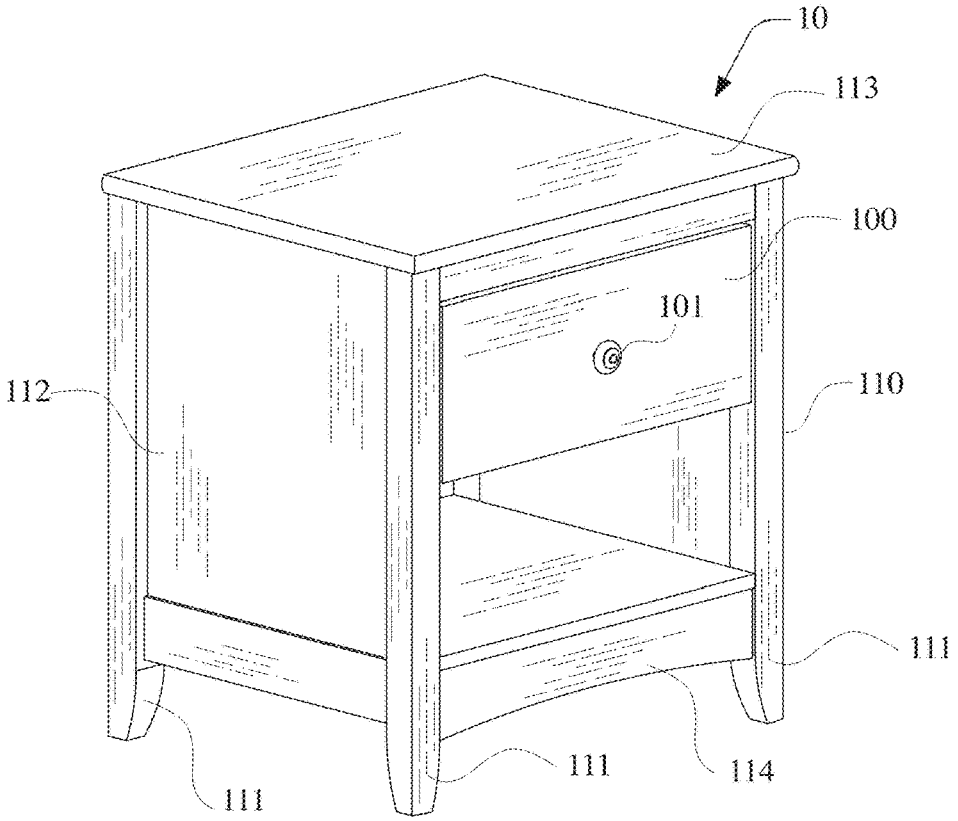
*Figure. 1*
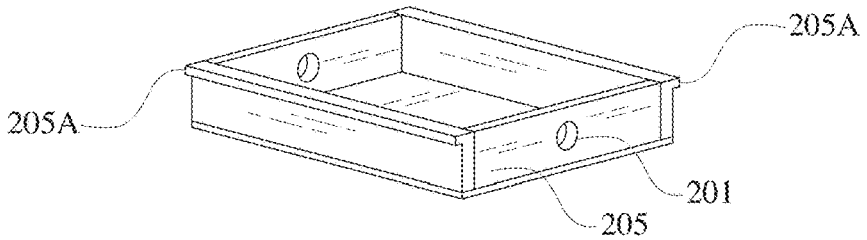
*Figure. 2*
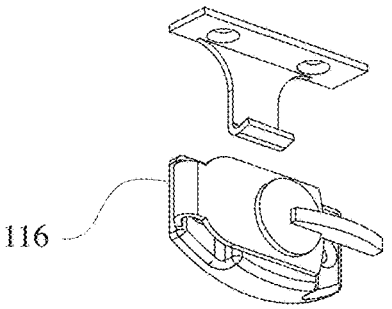
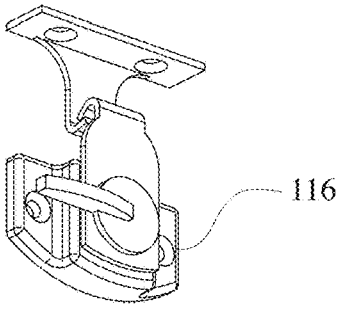
*Figure. 3* *Figure. 4*

FURNITURE OBJECTS INCLUDING HIDDEN CONTAINERS

This application is a divisional of and claims priority under 35 U.S.C. §§ 120/121 to U.S. application Ser. No. 16/374,947, filed on Apr. 4, 2019, the disclosure of which is incorporated herein in its entirety by reference. The present disclosure relates generally to furniture objects including secret and/or hidden containers.

FIELD

Background

The statements in this section merely provide background information related to the present disclosure and may not constitute prior art.

Furniture objects and/or apparatuses capable of providing a storage function (e.g., chests, cabinets, coffers, bureaus, armoires, night stands, desks, and/or any other like furniture objects) typically include storage compartments and/or storage containers (e.g., drawers). Many users of storage based furniture objects and/or storage based furniture apparatuses wish to store objects that have a perceived value in a hidden and/or concealed fashion. However, most typical storage based furniture objects and/or storage based furniture apparatuses do not include compartments and/or containers that may be hidden from view.

SUMMARY

Example embodiments relate to a furniture object including at least one secret and/or hidden container.

Example embodiments provide that the furniture object may be a chest, cabinet, coffer, bureau, armoire, night stand, desk, or any other like furniture object that may be configured to include and/or contain a secret and/or hidden container.

Example embodiments provide that the secret and/or hidden container may be a drawer and/or any other like container that is configured as a storage space.

At least one example embodiment relates to a furniture apparatus.

In some example embodiments, the furniture apparatus may include a frame; a movable facade configured to transition between an open state and a closed state; and a hidden container configured to rest on a set of support ledges attached to one or more of the frame and an unhidden container optionally associated with the furniture apparatus such that the hidden container is configured to be visible when the movable facade is in the open state, and the hidden container is configured to be hidden from view when the hidden container is installed in the furniture apparatus and the movable facade is in the closed state.

In some example embodiments, the hidden container includes an enclosure that is hidden from view when the movable facade is in the closed state.

In some example embodiments, the set of support ledges are attached to an underside of the frame, and the movable facade is a frame rail of the furniture apparatus.

In some example embodiments, the hidden container is configured to be drawn out horizontally in a first direction from the frame when the movable facade is in the open state.

In some example embodiments, the furniture apparatus further includes the unhidden container configured to be drawn out horizontally in a first direction from within an opening formed within the frame, the unhidden container being a container that is visible when the movable facade is in each of the open state and the closed state.

In some example embodiments, the set of support ledges are attached to an underside of the unhidden container, and the movable facade is a lower portion of a front face of the unhidden container.

In some example embodiments, the unhidden container is one of a plurality of unhidden containers that each form an enclosure, and the frame includes a plurality of openings therein each configured to receive a corresponding one of the plurality of unhidden containers, each of the plurality of unhidden containers being visible when the movable facade is in each of the open state and the closed state.

In some example embodiments, the movable facade is a middle rail of the furniture apparatus between two of the plurality of unhidden containers.

In some example embodiments, the set of support ledges include a sliding mechanism configured to allow the hidden container to slide horizontally.

In some example embodiments, the hidden container includes one or more protruding members protruding from a body of the hidden container, the hidden container configured to selectively rest on the set of support ledges via the one or more protruding members.

In some example embodiments, the furniture apparatus further includes a securing device configured to selectively secure the movable facade in the closed state when the securing device is secured, and to allow the movable facade to transition to the open state when the securing device is unsecured.

In some example embodiments, the securing device is a latch or a magnetic catch having a first portion attached to the frame and a second portion attached to the movable facade.

In some example embodiments, the furniture apparatus further includes a stopper on the frame, the stopper configured to define a maximum position of the movable facade when the movable facade transitions to the open state.

In some example embodiments, the furniture apparatus further includes at least one hinge configured to hingeably secure the movable facade to the frame.

In some example embodiments, the at least one hinge is an invisible hinge such that the hinge is not visible when the movable facade is in the closed state.

In some example embodiments, a pivot point of the at least one hinge is offset at a distance from the movable facade such that the movable facade falls along an arc when transitioning to the open position.

In some example embodiments, a path of the movable facade follows a specified arc as it moves from the closed position to the open position such that in the open position the movable facade rests below the hidden container and within a space defined by leg posts associated with the frame of the furniture apparatus.

In some example embodiments, the movable facade is connected to a block extending perpendicular to the movable facade, the block being hingeably attached to the frame such that the block defines a moment arm of the movable façade when the movable facade transitions between the closed state and the open state.

Some other example embodiments relate to a method of constructing a furniture apparatus including a hidden container concealable from view. In some example embodiments, the method includes assembling a frame of the furniture apparatus; installing a movable facade such that the movable facade is configured to transition between an open state and a closed state; installing a set of support ledges to one or more of the frame and an unhidden container optionally associated with the furniture apparatus; and placing the hidden container on the set of support ledges such that the hidden container is configured to be visible when the movable facade is in the open state, and the hidden container is configured to be hidden from view when the hidden container is installed in the furniture apparatus and the movable facade is in the closed state.

Some other example embodiments relate to a furniture apparatus comprising: a frame including an opening configured to receive at least a hidden container; and a movable facade configured to transition between an open state and a closed state, wherein the hidden container is configured to rest on a set of support ledges attached to one or more of the frame and an unhidden container optionally associated with the furniture apparatus such that the hidden container is configured to be visible when the movable facade is in the open state, and the hidden container is configured to be hidden from view when the hidden container is installed in the furniture apparatus and the movable facade is in the closed state.

Further areas of applicability will become apparent from the description and figures provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

FIG. 1 illustrates a furniture apparatus including at least one secret and/or hidden container in a closed state according to an example embodiment;

FIG. 2 illustrates a secret and/or hidden container according to an example embodiment;

FIGS. 3 and 4 illustrates a latch for a secret and/or hidden container according to an example embodiment;

DETAILED DESCRIPTION

Figure 5:
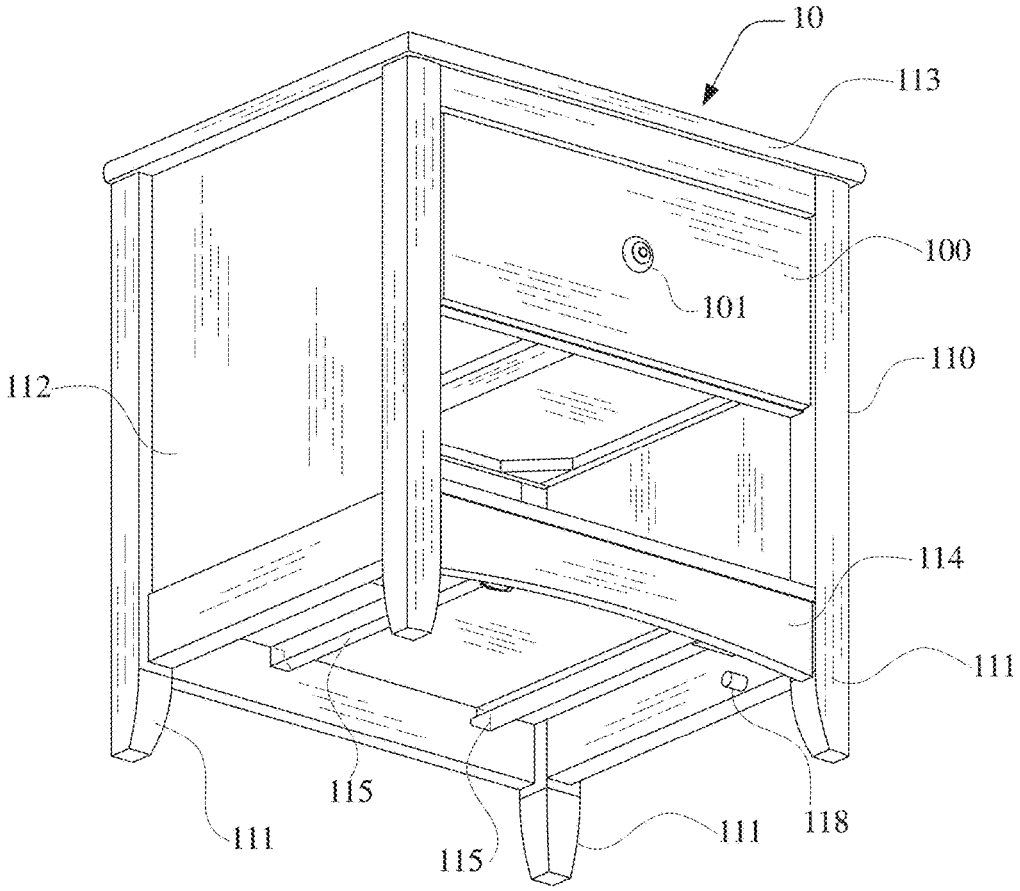
FIGS. 5 and 6 illustrates a furniture apparatus in a closed state with the secret and/or hidden container removed therefrom according to an example embodiment.

The following description is merely example in nature and is not intended to limit the present disclosure, application, or uses. It should be understood that throughout the drawings, corresponding reference numerals indicate like or corresponding parts and features.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof. As used herein, the term "and/or" includes any and all combinations of one or more of the associated listed items.

It will be understood that, although the terms first, second, third etc. may be used herein to describe various elements, components, regions, portions, and/or sections, these elements, components, regions, portions, and/or sections should not be limited by these terms. These terms are only used to distinguish one element, component, region, portion, or section from another element, component, region, portion, or section. Thus, a first element, component, region, portion, or section discussed below could be termed a second element, component, region, portion, or section without departing from the scope of the example embodiments.

Certain terminology is used herein for purposes of reference only, and thus is not intended to be limiting. For example, terms such as "upper," "lower," "above," "below," "top," "bottom," "upward," "downward," "upwardly," "downwardly," "forward," "rearward," and the like refer to directions in the drawings to which reference is made. Terms such as "front," "back," "rear," "bottom," "side," and the like describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first," "second," and other such numerical terms referring to structures do not imply a sequence or order unless clearly indicated by the context.

Example embodiments will now be described more fully with reference to the accompanying drawings. Example embodiments may, however, be embodied in many different forms and should not be construed as being limited to the example embodiments set forth herein. Rather, these example embodiments are provided so that this disclosure will be thorough, and will fully convey the example embodiments to those skilled in the art.

Example embodiments relate to a furniture apparatuses including at least one secret and/or hidden container. Example embodiments provide that the furniture apparatus may be a chest, a chest of drawers, a cabinet, a coffer, a bureau, an armoire, a night stand, a desk, or any other like furniture object or apparatus that may be configured to include and/or contain a secret and/or hidden container. Example embodiments provide that the secret and/or hidden container may be a drawer and/or any other like container that is configured as a storage space.

The furniture object including at least one secret and/or hidden container may be in a shape and configuration as shown by the accompanying figures. The furniture object including at least one secret and/or hidden container may be operated according to methods as shown by the accompanying figures.

Figure 6:
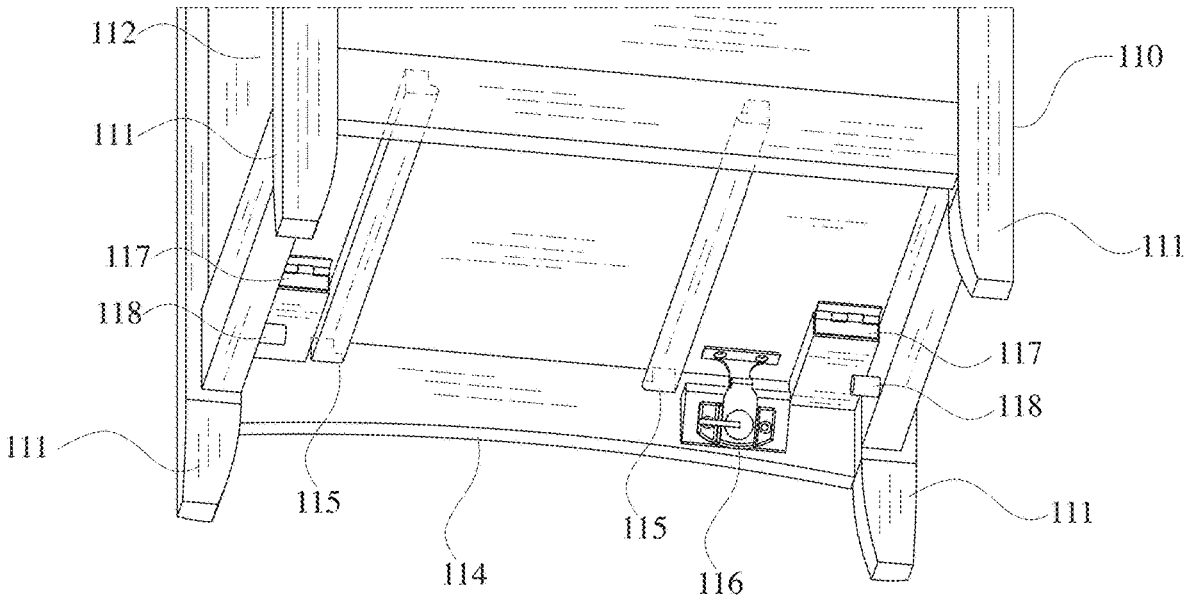
Figure 7:
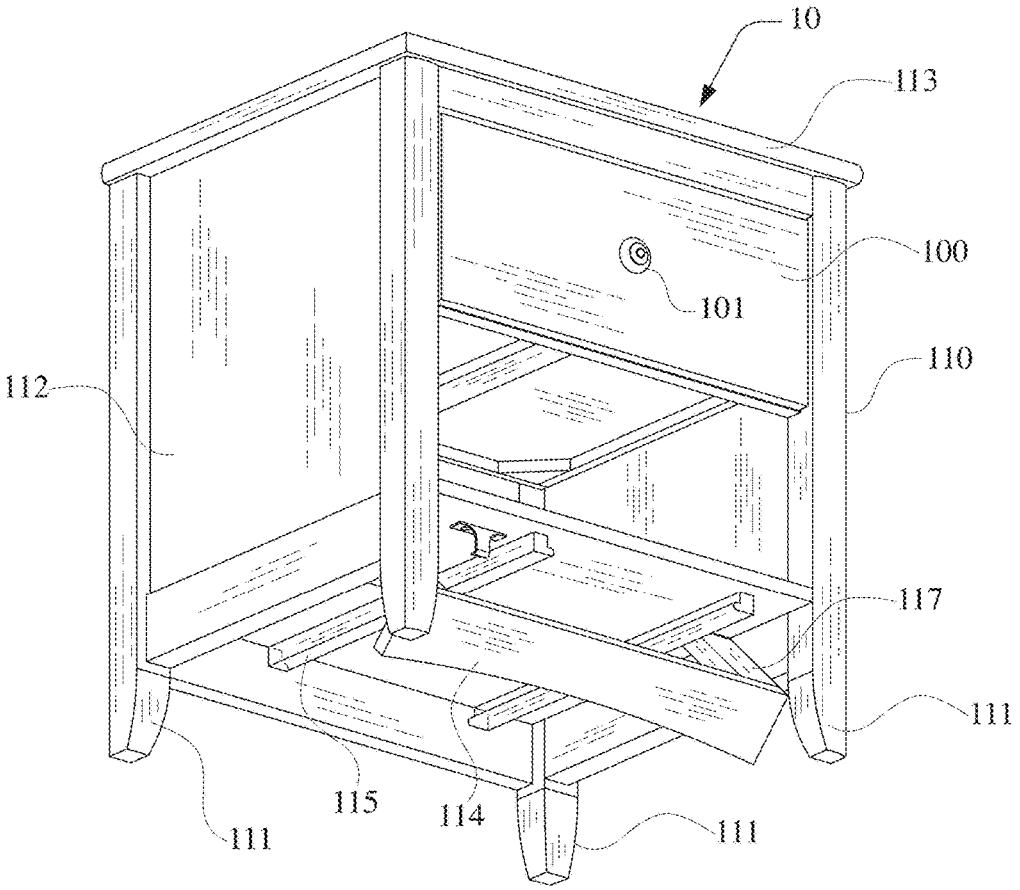
FIGS. 7 and 8 illustrate a furniture apparatus in an open state with the secret and/or hidden container removed therefrom according to an example embodiment.
Figure 8:
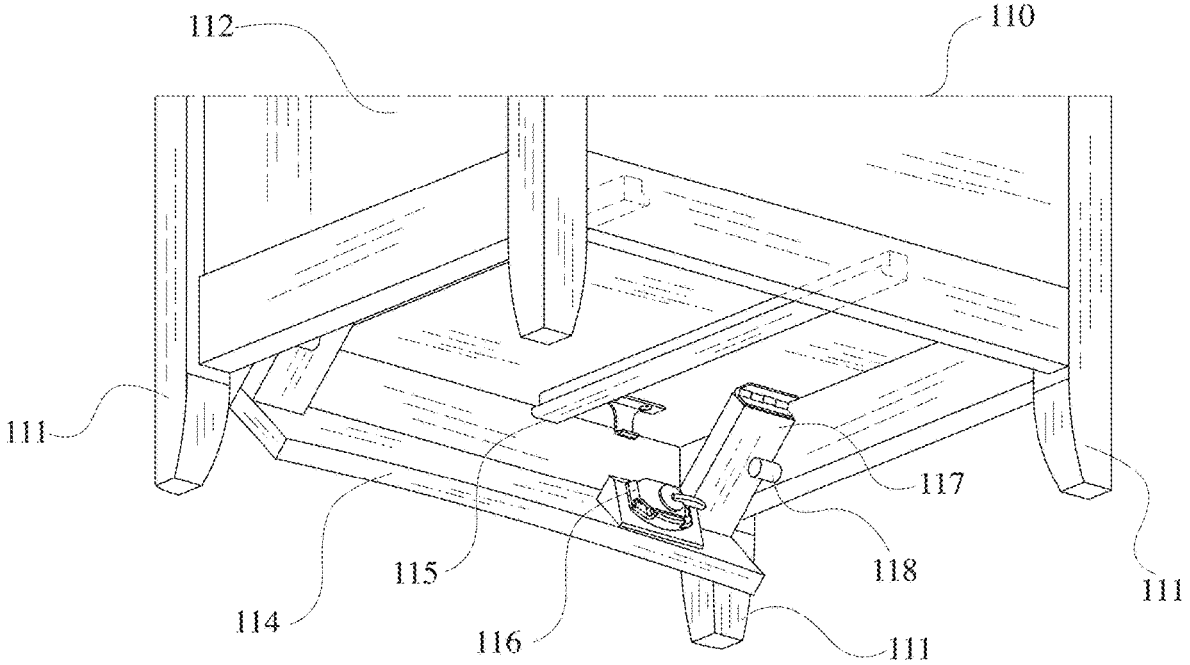
Figure 9:
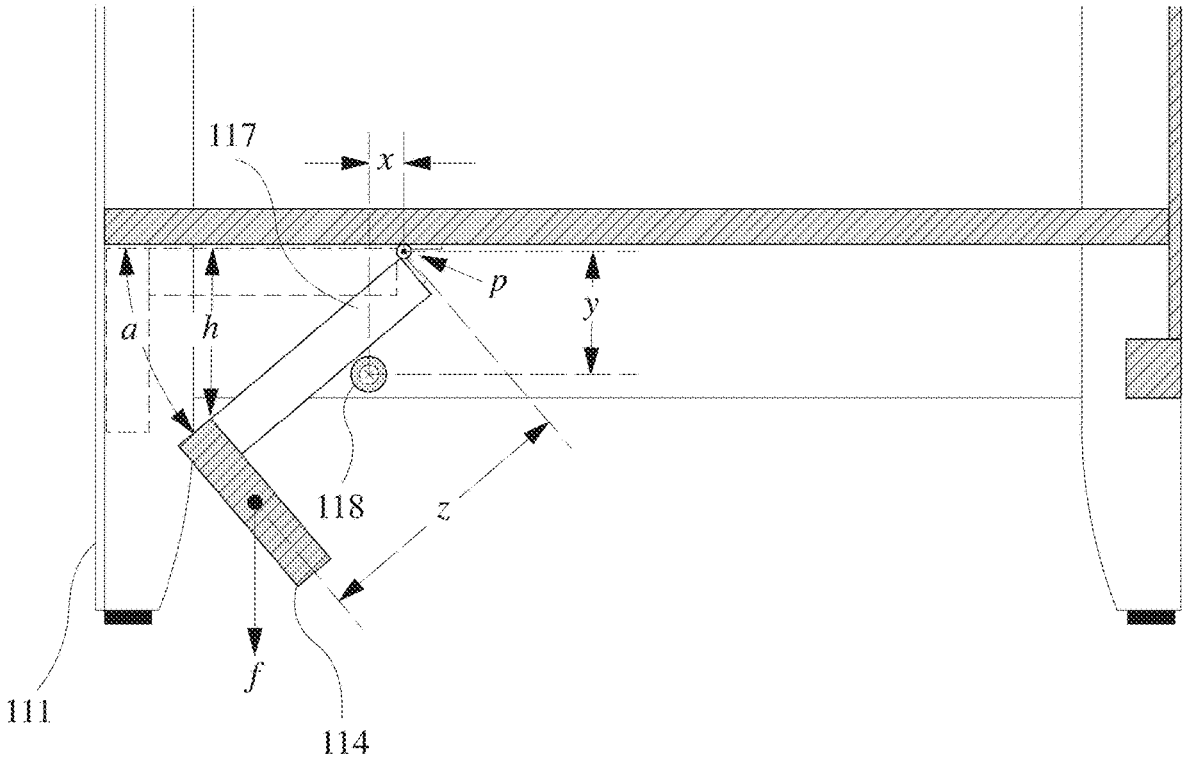
FIG. 9 illustrates a movable facade of a furniture apparatus transitioning from a closed state to an open state.
Figure 10:
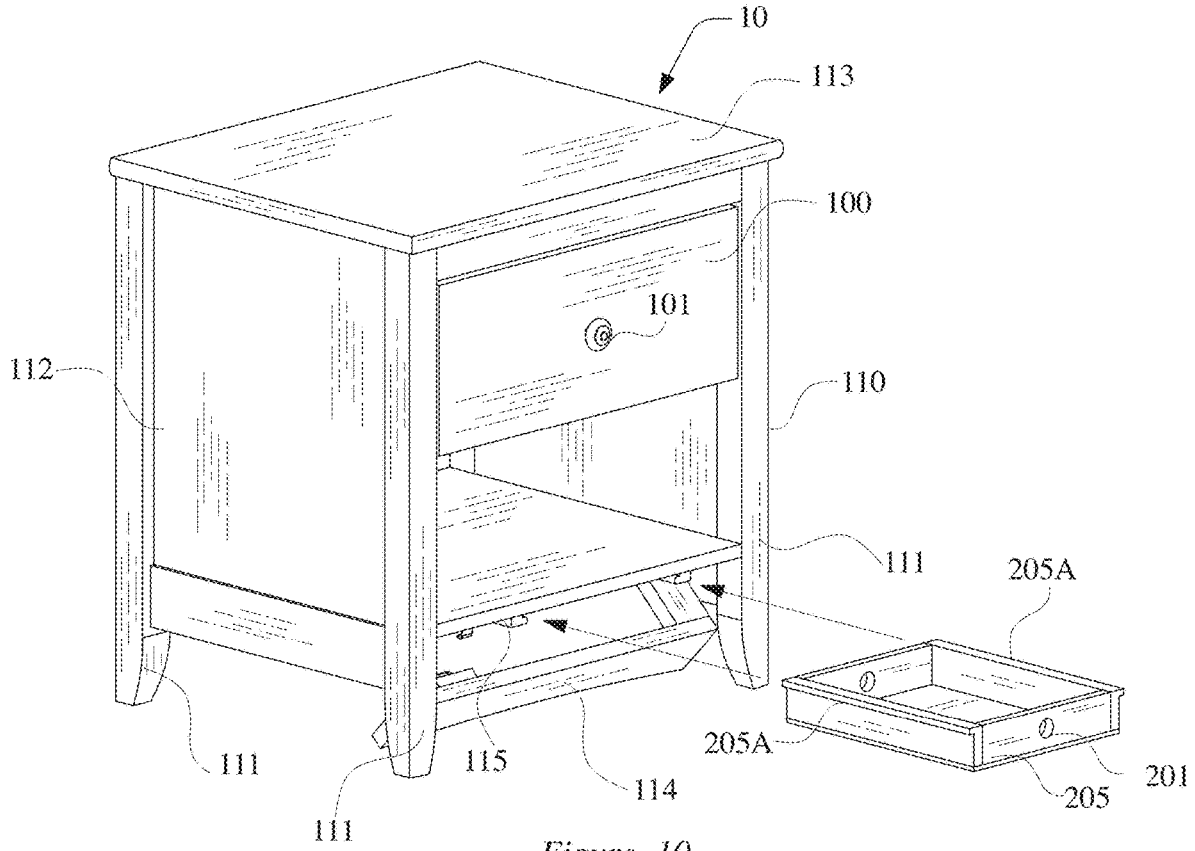
FIGS. 10 to 15 illustrate insertion of a secret and/or hidden container into a furniture apparatus according to an example embodiment
Figure 11:
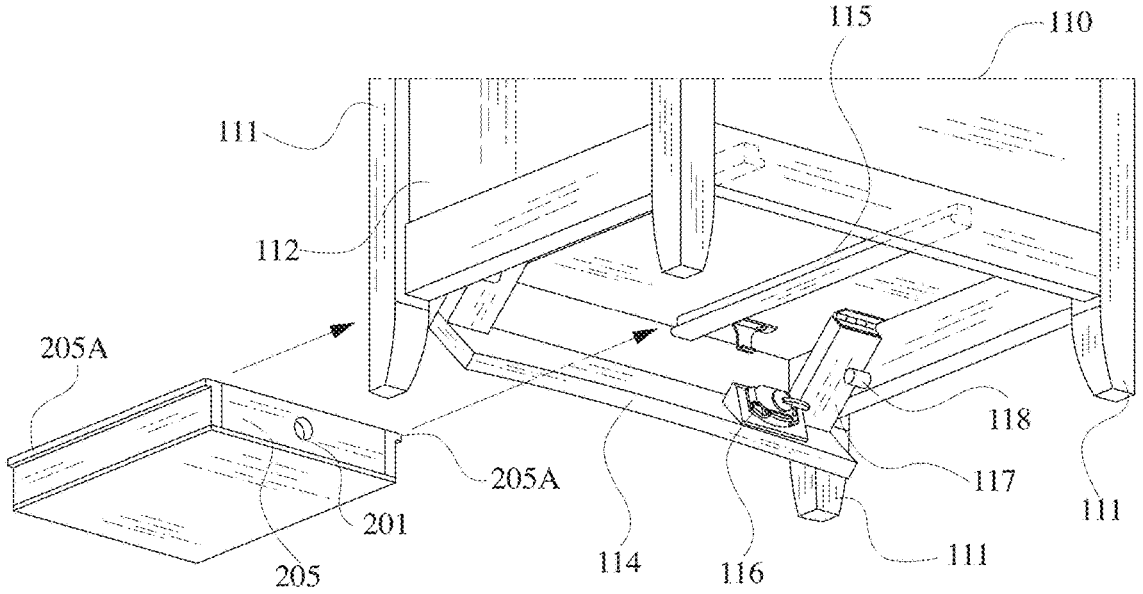

FIG. 1 illustrates a furniture apparatus including at least one secret and/or hidden container in a closed state according to an example embodiment. FIG. 2 illustrates a secret and/or hidden container according to an example embodiment. FIGS. 3 and 4 illustrates a latch for a secret and/or hidden container according to an example embodiment. FIGS. 5 and 6 illustrates a furniture apparatus in a closed state with the secret and/or hidden container removed therefrom according to an example embodiment. FIGS. 7 and 8 illustrate a furniture apparatus in an open state with the secret and/or hidden container removed therefrom according to an example embodiment. FIG. 9 illustrates a movable facade of a furniture apparatus transitioning from a closed state to an open state.

Referring to FIGS. 1 to 9, a furniture apparatus 10 may include a frame 110 that includes a pair of side panels 112 and a top surface 113. The furniture apparatus 10 may also optionally include a rear panel (not shown). Further, in some example embodiments, the furniture apparatus 10 may include legs 111. However, example embodiments are not limited thereto, and in various other example embodiments, the legs 111 may be omitted.

The furniture apparatus 10 may further include a movable facade 114, which in some example embodiments may be a bottom rail 114. As discussed in more detail below, the movable facade 114 may appear as a structural piece of the frame 110 but may not provide structural support to the frame 110 but rather are provided to deceptively present the appearance of structural support while being movable from a closed state to an open state to expose a hidden compartment.

The furniture apparatus 10 may be configured to receive at least one unhidden container 100 and hidden container 205. The unhidden container 100 may include a handle 101.

Together, the side panels 112 and top surface 113 of the frame 110 form an enclosure that holds or otherwise includes the unhidden container 100. Further, as discussed in more detail below, in some example embodiments, the enclosure may also hold the hidden container 205. The legs 111 are configured to provide stability and/or support for the furniture apparatus 10.

As shown in FIGS. 1 to 7, the unhidden container 100 may be in a closed position or an open position. When in the closed position, the unhidden container 100 together with the top 113 forms an enclosure capable of storing objects. The unhidden container 100 is configured to be drawn out horizontally from the frame 110 of the furniture apparatus 10 when transitioning from the closed position to the open position. In the open position, a user of the furniture apparatus 20 may place objects inside the unhidden container 100.

The furniture apparatus 10 may include sliders (not shown) upon which the unhidden container 100 slides as it is transitioned between the closed position and the open position. The sliders may be friction sliders, ball-bearing sliders, roller-bearing sliders, progressive action slides, and/or any other like apparatus and/or mechanism that enables the unhidden container 100 to be drawn out and/or pushed in a substantially horizontal fashion. The sliders may be located within the enclosure formed by the frame 110 and/or the sliders may be attached to the unhidden container 200.

Additionally, the sliders and/or runners may be configured to allow the unhidden container 100 to detach/attach to the frame 110 such that the unhidden container 100 can be removed/inserted into the enclosure formed by the frame 110.

The handle 101 of the unhidden container 100 may be any type of handle, knob, latch, hook, and/or any other like protrusion that facilitates the unhidden container 100 to transition from the closed state to the open state. In some embodiments, unhidden container 100 may include any another type of mechanism by which to open the unhidden container 100, including holes cut in the front face of the unhidden container 100, a hollowed-out area to insert a user's fingers into the front face of the unhidden container 100, and the like.

The unhidden container 100 and/or the hidden container 205 may be any container that fits into the furniture apparatus 10, and/or any other like object. The unhidden container 100 and/or the hidden container 205 may be constructed, manufactured, or otherwise built in a variety of shapes include any rectangular shape, square shape, and the like. The furniture apparatus 10, the unhidden container 100, and/or the hidden container 205 may be constructed, manufactured, or otherwise built using a variety of materials, such as wood, plastic, metal, minerals and/or any combination thereof. In various embodiments, the unhidden container 100 may be designed such that a front face of the unhidden container 100 is flush with, or otherwise aligned with the side panels 112 when the unhidden container 100 is in the closed state.

The furniture apparatus 10 may be configured such that the hidden container 205 may be located within the enclosure formed by the frame 110.

In some example embodiments, the hidden container 205 may be hidden underneath the frame 110 (i.e., an undercarriage of the frame 110).

The frame 110 may include tracks 115 upon which the hidden container 205 may rest. The tracks 115 may be provided in pair and extend perpendicular to each other along a bottom surface of the enclosure formed by the frame 110. Further, the hidden container may include protrusions 205A (or, alternatively, wings) extending from at least two surfaces thereof that allow the hidden container 205 to glide along the tracks 115 inside the enclosure formed by the frame 110. However, example embodiments are not limited thereto, and the tracks 115 may include one or more protrusions, sliders, latches, hooks, and/or any other like mechanism that allows the hidden container 205 to be supported by or otherwise be received by the undercarriage of the frame 110.

In some embodiments, when the movable facade 114 is in the closed state, the hidden container 205 may be hidden. The hidden container 205 may be hidden, concealed, or otherwise made invisible by placing the hidden container 205, for example, into the tracks 115 underneath the frame 110 and closing the movable facade 114.

The hidden container 205 may be removed via grasping finger holes 201 therein. Further, the hidden container 205 may have a cover (not shown) associated therewith, that allows items stored within the hidden container 205 to remain hidden when the hidden container 205 is otherwise exposed.

In some example embodiments, the movable facade 114 may articulate to expose the hidden container 205, and the hidden container 205 may then be removed, for example, via grasping finger holes 201 therein. For example, when the movable facade 114 is the bottom rail as shown in FIG. 1, the movable facade 114 may articulate from the closed state downwards to the open state in response to a user opening a securing device 116 to allow gravity to force the bottom rail 114 downwards such that the bottom rail 114 swings on hinges 117 until the bottom rail 114 (or, alternatively a block attached thereto) contacts a stopper 118 attached to an underside of the frame 110. In some example embodiments, as illustrated in FIG. 8, the hinge 117 may be attached to a block such that the block extends from a rear surface of the bottom rail 114 to a bottom surface of the frame 110.

In some example embodiments the movable facade 114 may be perpendicularly attached to the hinges 117 via wood blocks to form a moment arm having a length z which is hingeably attached to the furniture apparatus and thereby rotational around pivot points p of the hinges 117. The pivot points p of the hinges 117 are the center of a circle in which the line of the wood blocks are the radius and the movable facade 114 sits at the point of tangency. A mechanical advantage is achieved in this configuration due to the moment arm z increasing the rotational torque of the movable facade 114 as gravity creates a downward gravitational force f.

For example, in the aforementioned configuration, when the movable facade 114 is unlatched by a user, the gravitational force f may generate the rotational torque to force the movable facade 114 to fully swing downward along an arc a until the movable facade 114 (or, alternatively, the block perpendicularly attached thereto) encounters the stopper 118 arranged a vertical distance y down and a horizontal distance x over from the pivot point p of the hinge 117 such that the movable facade 114 drops a horizontal distance h to reveal the concealed hidden container 205. As such, other than when purposely in motion, the movable facade 114 will be either solely in the latched, closed position or solely in the fully open position. If a movable facade were allowed to be simply ajar or only partially open along its downward path, a user may unwittingly reveal the hidden container to a casual observer. In contrast, in one or more example embodiments, the movable facade 114 will rest in either a fully open or fully latched and closed state and, thus, the user may be certain as to the state of the movable facade 114.

In the example embodiment the length of the wood block and the location of the stopper 118 to stop the downward swing of the movable facade 114 are calculated to ensure maximum ease and effectiveness of use. In this configuration the movable facade 114 easily swings fully open and arrives at rest well below the hidden container 205 and sufficiently behind the posts of the front legs 111 to allow the user unencumbered and easy access to the hidden container 205.

Harnessing gravity and its line of force to ensure the movable facade will swing open, rather than utilizing more complex mechanics, allows the furniture apparatus 10 to be manufactured at a relatively low production cost.

FIGS. 10 to 15 illustrate insertion of a secret and/or hidden container into a furniture apparatus according to an example embodiment.

Figure 12:
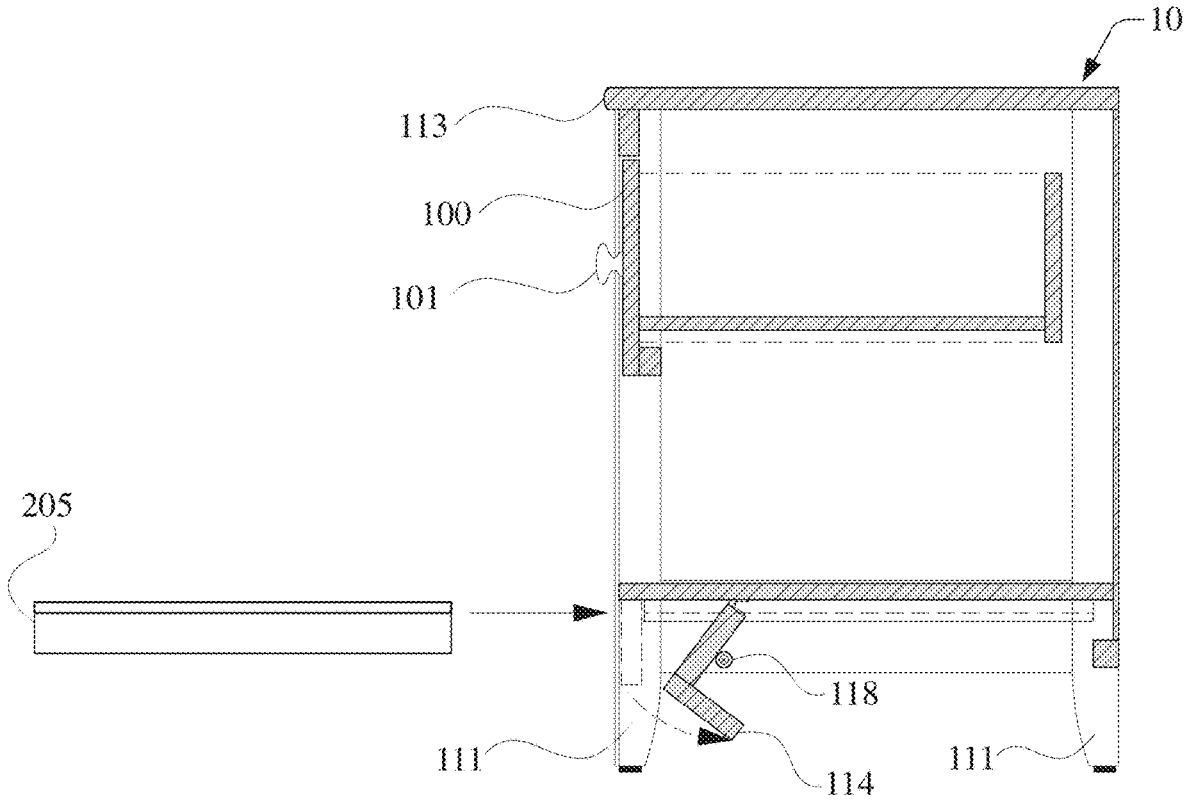
Figure 13:
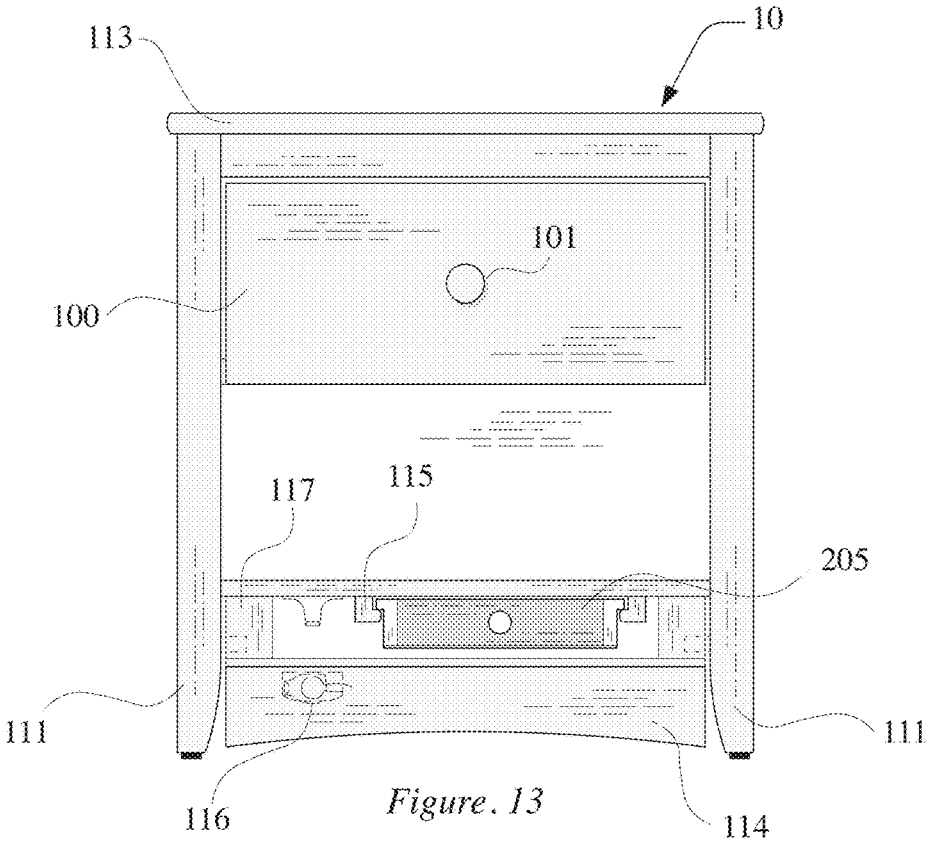

Referring to FIGS. 10 to 15, to insert the hidden container 205 into the furniture apparatus 10, the user may move the movable facade 114. For example, in some example embodiments, the user may open the securing device 116 that is holding the movable facade 114 in the closed state, and then the movable facade 114 may fall downwards until the movable facade 114 contacts the stopper 118. For example, when the securing device 116 is a latch, the user may switch the latch 116 from a closed position to an open position to cause the securing device 116 to open. Thereafter, as illustrated in FIG. 12, the user may insert the hidden container 205 into the furniture apparatus 10.

Figure 14:
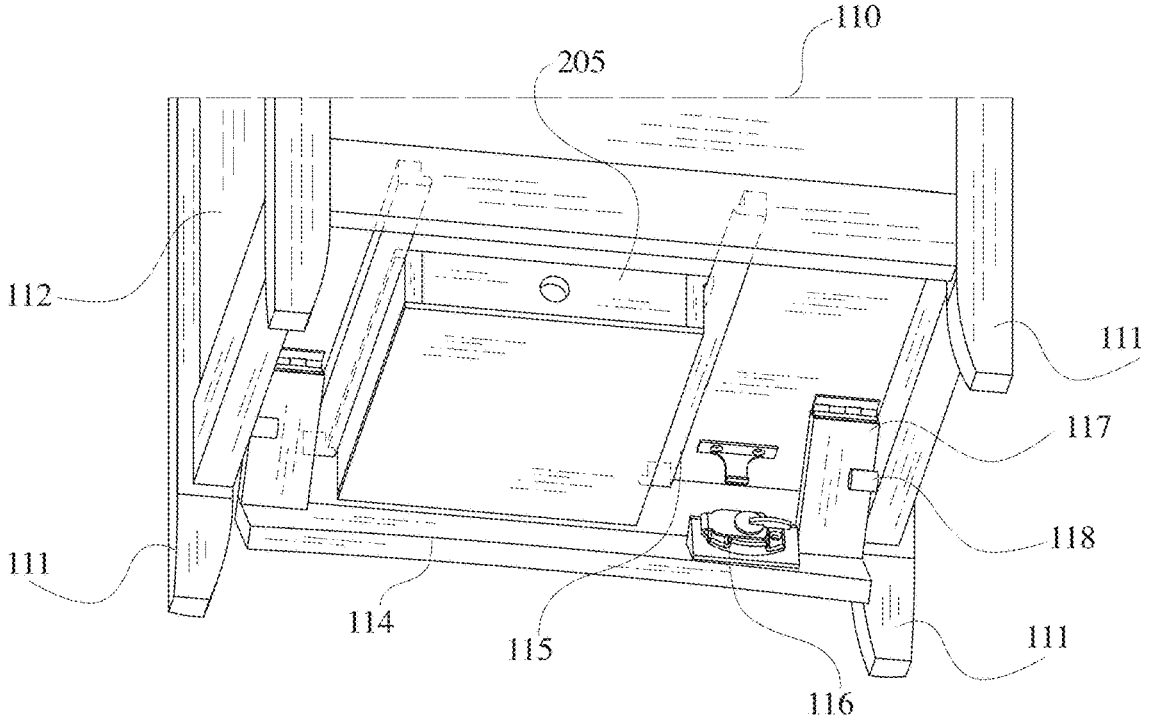
Figure 15:
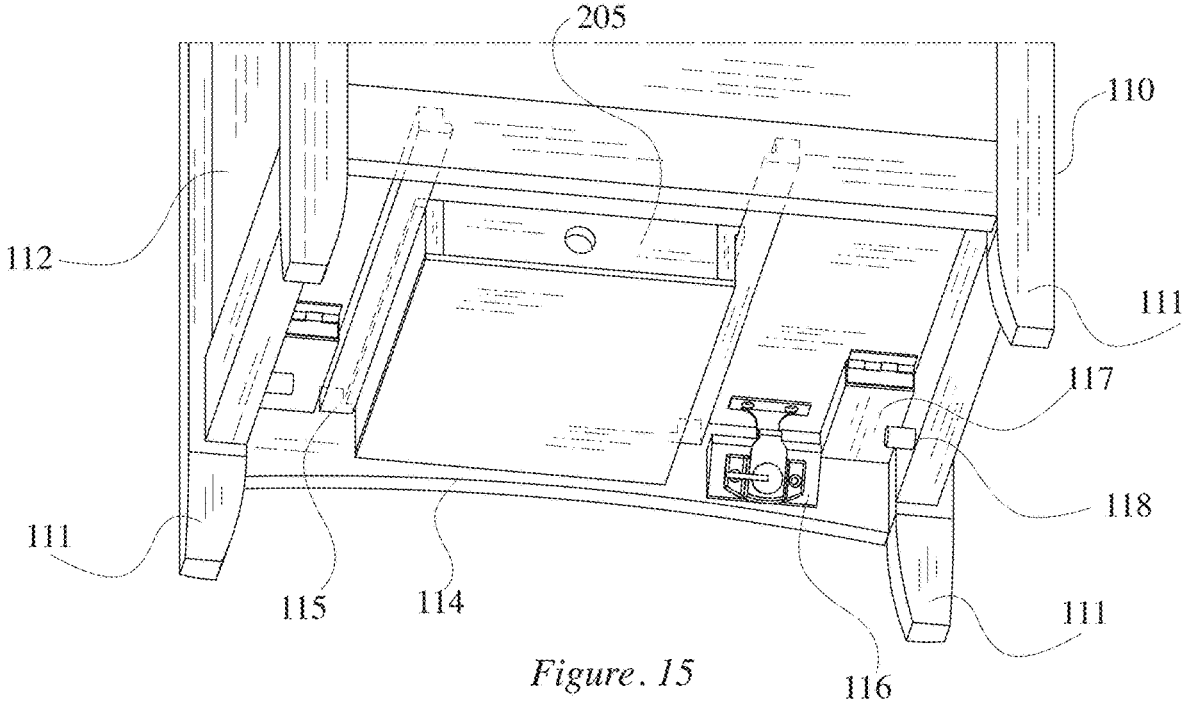

As illustrated in FIGS. 14 and 15, once the user has inserted the hidden container 205, the user may return the movable facade 114 to the closed state by lifting the movable facade 114 upwards and allowing the securing device 116 to lock the movable facade 114 in place. For example, when the securing device 116 is the latch, the user may switch the securing device 116 from the open position to the closed position to cause the securing device 116 to close to secure the movable facade 114.

Figure 16:
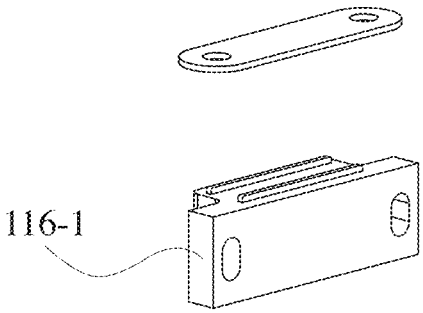
FIG. 16 illustrates a magnetic catch for a secret and/or hidden container according to an example embodiment.
Figure 17:
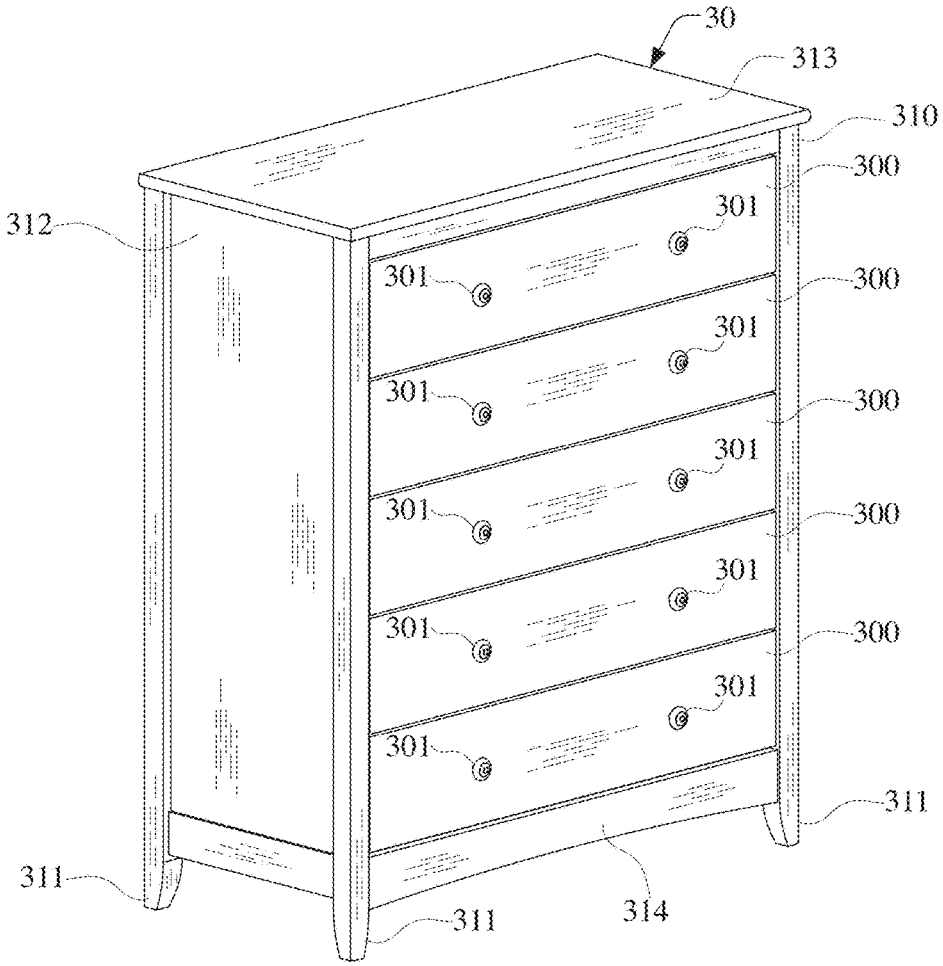
FIGS. 17 to 20 illustrate a furniture apparatus including at least one secret and/or hidden container according to another example embodiment.
Figure 18:
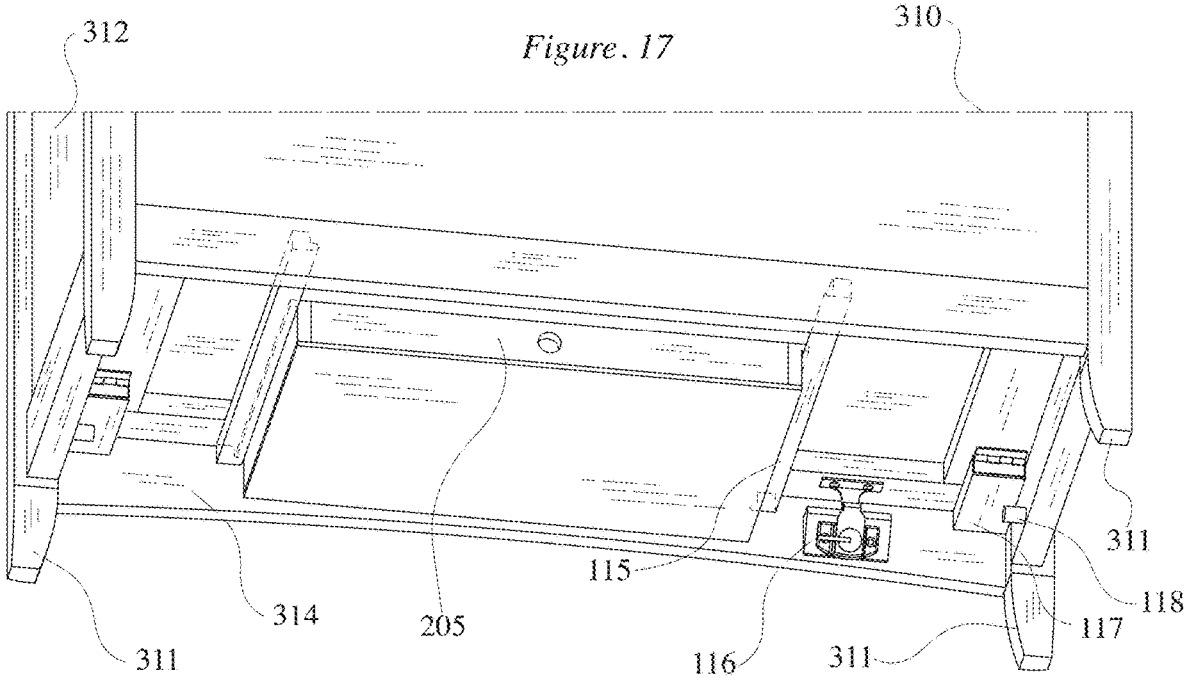
Figure 19:
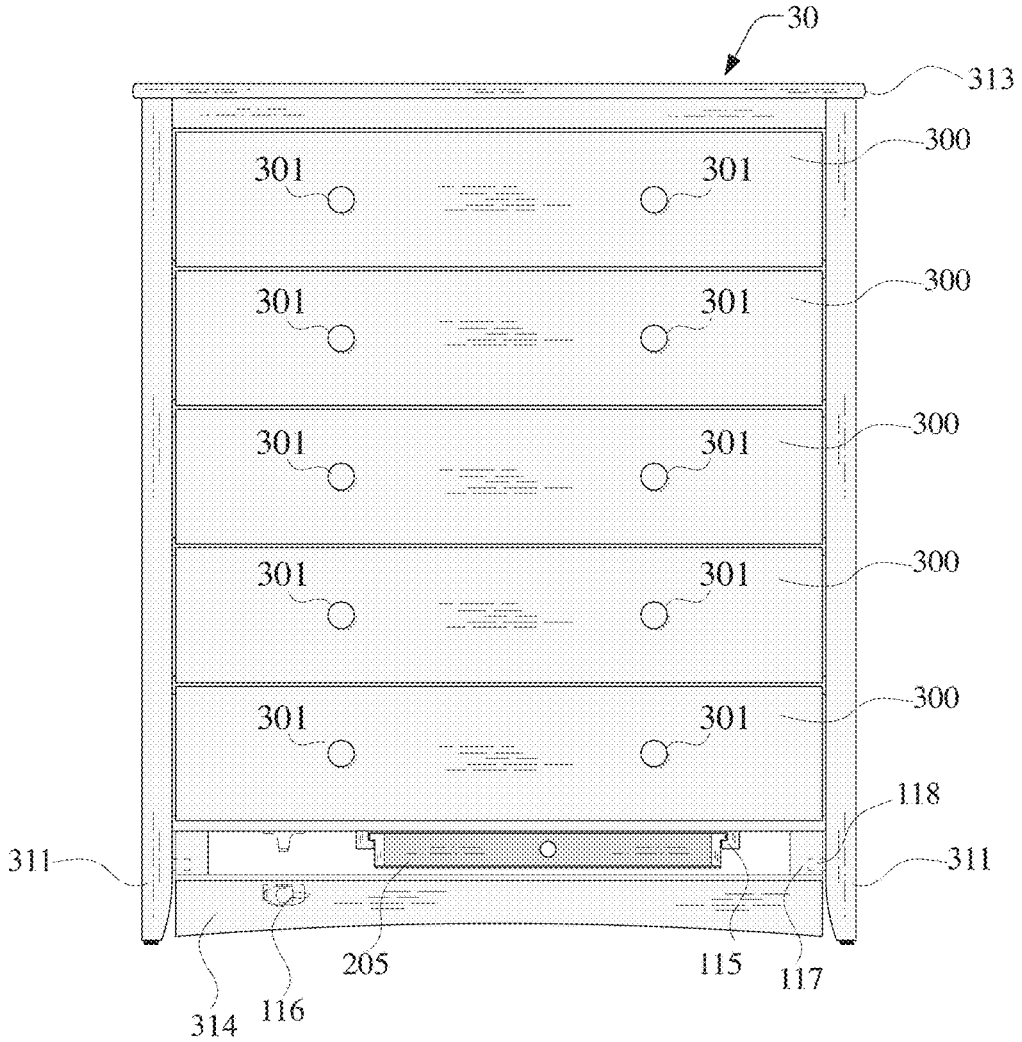
Figure 20:
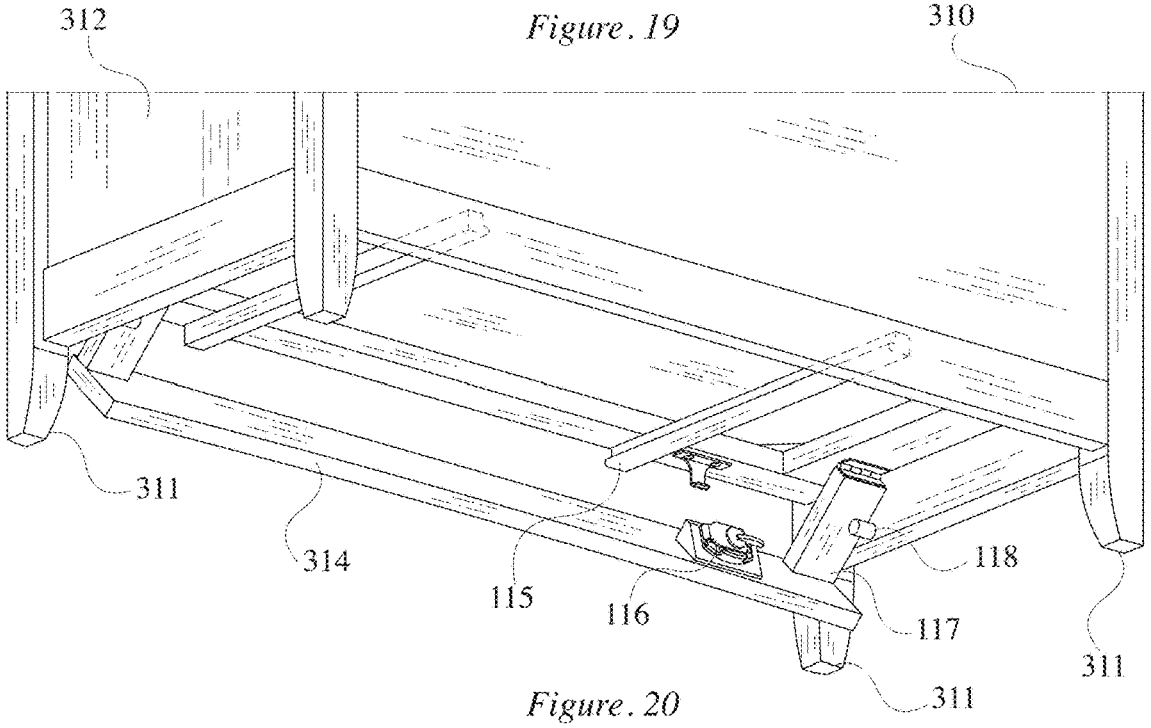
Figure 21:
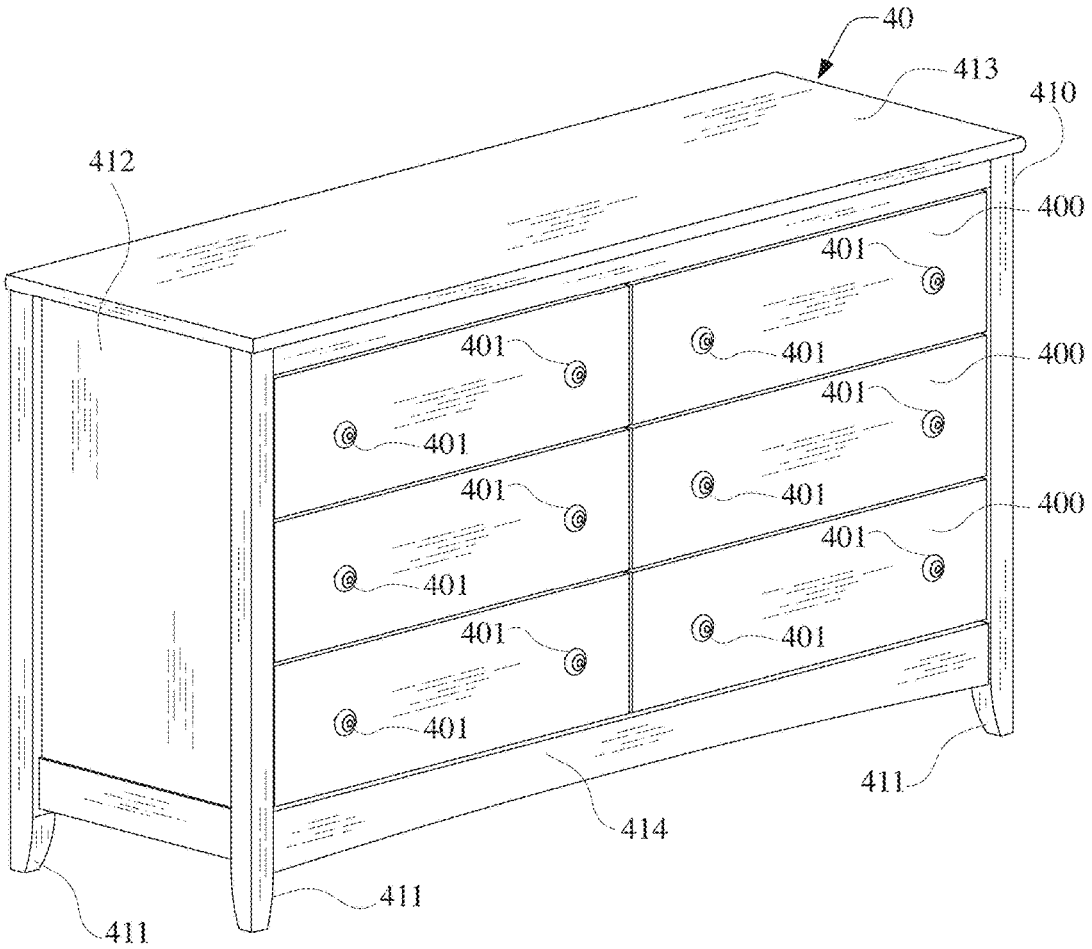
FIGS. 21 to 24 illustrate a furniture apparatus including at least one secret and/or hidden container according to another example embodiment.
Figure 22:
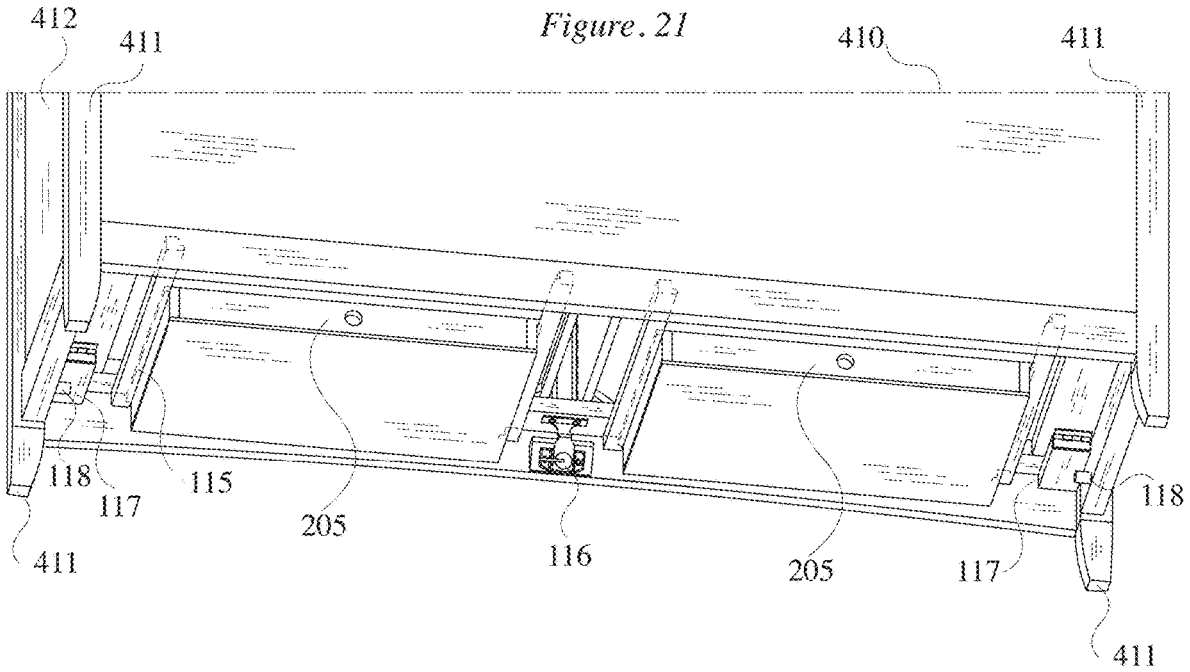
Figure 23:
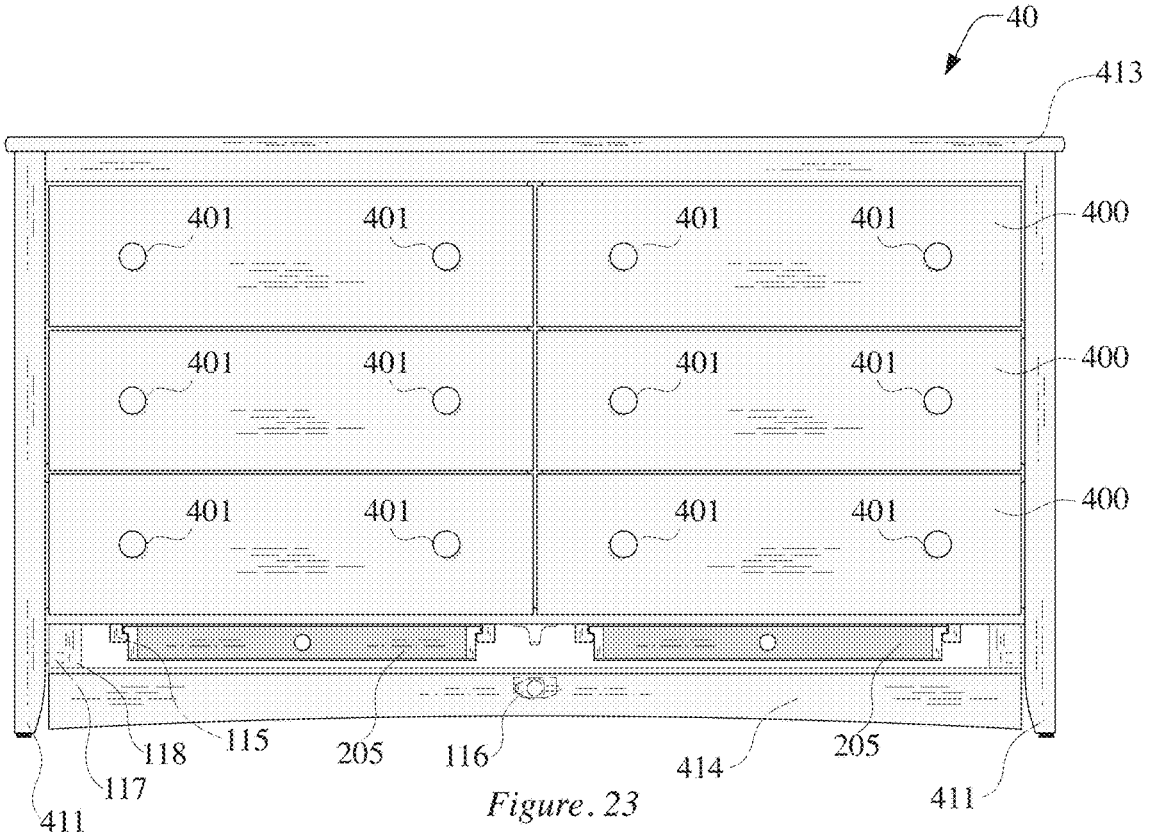

FIG. 16 illustrates a magnetic catch for a secret and/or hidden container according to an example embodiment;

Referring to FIG. 16, in some other example embodiments, the securing device 116 may be a magnetic catch 116-1 rather than a latch, such that the movable facade 114 is configured to switch to the open state when a threshold amount of force greater than the magnetic force holding the movable facade 114 in the closed state is applied to the movable facade 114. Further, the movable facade 114 may be switched to the closed state when the movable facade 114 is articulated upwards to a point where the magnetic catch 116-1 installed on a first one of the movable facade 114 and the frame 110 catches an armature plate installed on a second one of the movable facade 114 and the frame 110.

FIGS. 17 to 20 illustrate a furniture apparatus including at least one secret and/or hidden container according to another example embodiment.

Referring to FIGS. 17 to 20, a furniture apparatus 30 may include a frame 310 that includes a pair of side panels 312 and a top surface 313. The furniture apparatus 30 may also optionally include a rear panel (not shown). Further, in some example embodiments, the furniture apparatus 30 may include legs 311. However, example embodiments are not limited thereto, and in various other example embodiments, the legs 311 may be omitted.

Together, the side panels 312 and top surface 313 of the frame 310 form an enclosure that holds or otherwise includes the hidden container 205 and/or a unhidden container 300. The unhidden container 300 may include one or more corresponding handles 301.

Further, the furniture apparatus 30 may include a movable facade 314 that is configured to move to selectively enclose the hidden container 205. The movable facade 314 may appear as a structural piece of the frame 310 but may not be provide structural support to the frame 310. Rather, the movable facade 314 is provided to deceptively present the appearance of structural support while being movable from a closed state to an open state to expose a hidden compartment housing the hidden container 205.

The frame 310, legs 311, side panels 312, top 313 and movable facade 314 may be the same or similar to frame 110, legs 111, side panels 112, and top 113, and movable facade 114 respectively.

The unhidden container 300 and/or the hidden container 205 may be the same or similar to the unhidden container 100 and/or the hidden container 205 as discussed previously with regard to FIGS. 1 and 2. Furthermore, handles 301 may be the same or similar to the handle 101.

Further, in some example embodiments, when the furniture apparatus 30 is a chest, the unhidden container 300 may be provided in plural where the plurality of unhidden containers 300 are arranged in a column.

In some example embodiments, similar to the furniture apparatus 10, an undercarriage the furniture apparatus 30 may include the tracks 115 upon which the hidden container 205 may rest, and the movable facade 314 may articulate downwards to selectively expose the hidden container 205.

FIGS. 21 to 24 illustrate a furniture apparatus including at least one secret and/or hidden container according to another example embodiment;

Referring to FIGS. 21 to 24, a furniture apparatus 40 may include a frame 410 that includes a pair of side panels 412 and a top surface 413. The furniture apparatus 40 may also optionally include a rear panel (not shown). Further, in some example embodiments, the furniture apparatus 40 may include legs 411. However, example embodiments are not limited thereto, and in various other example embodiments, the legs 411 may be omitted.

Together, the side panels 412 and top surface 413 of the frame 410 form an enclosure that holds or otherwise includes the hidden container 205 and/or a unhidden container 400. The unhidden container 400 may include one or more corresponding handles 401.

Further, the furniture apparatus 30 may include a movable facade 414 that is configured to move to selectively enclose the hidden container 205. The movable facade 414 may appear as a structural piece of the frame 310 but may not be provide structural support to the frame 310. Rather, the movable facade 414 is provided to deceptively present the appearance of structural support while being movable from a closed state to an open state to expose a hidden compartment housing the hidden container 205.

The frame 410, legs 411, side panels 412, and top 413 may be the same or similar to frame 110, legs 111, side panels 112, and top surface 113, respectively.

Each of the plurality of unhidden containers 400 may be in a closed state. When in the closed state, the unhidden containers 400 together with the top surface 413 form enclosures that fulfill a storage function of the furniture apparatus 30. The unhidden containers 400 and/or the hidden container 205 may be the same or similar to the unhidden container 100 and/or the hidden container 205 as discussed previously with regard to FIGS. 1 and 2. Furthermore, handles 401 may be the same or similar to the handle 101.

In some example embodiments, similar to the furniture apparatus 10, an undercarriage the furniture apparatus 40 may include the tracks 115 upon which the hidden container 205 may rest, and the bottom rail 414 may articulate to selectively expose the hidden container 205.

Further, in some example embodiments, when the furniture apparatus 40 is a dresser, the plurality of unhidden containers 40 may be arranged in two or more columns. As such, the undercarriage of the furniture apparatus 40 may include plural sets of tracks 115, hinge 117, stoppers 118 each corresponding to one of the columns. Further, while the furniture apparatus 40 may include plural hidden containers 205 each corresponding to one of the columns, the furniture apparatus 40 may only include a single bottom rail 414 and a single securing device 116. However, example embodiments are not limited thereto, and in other example embodiments, different ones of the single securing device 116, hinge 117, and stopper 118 may be provided singularly or in plural.

FIGS. 25 to 29 illustrate a furniture apparatus including at least one secret and/or hidden container according to other example embodiments.

Referring to FIGS. 25 to 29, in some example embodiments, moving via the hinge 117, the movable facade 314 may move via a roller hinge 117-1 that allows the movable facade 314 to articulate in one of an upwards or downwards direction to expose the hidden container 205.

Figure 24:
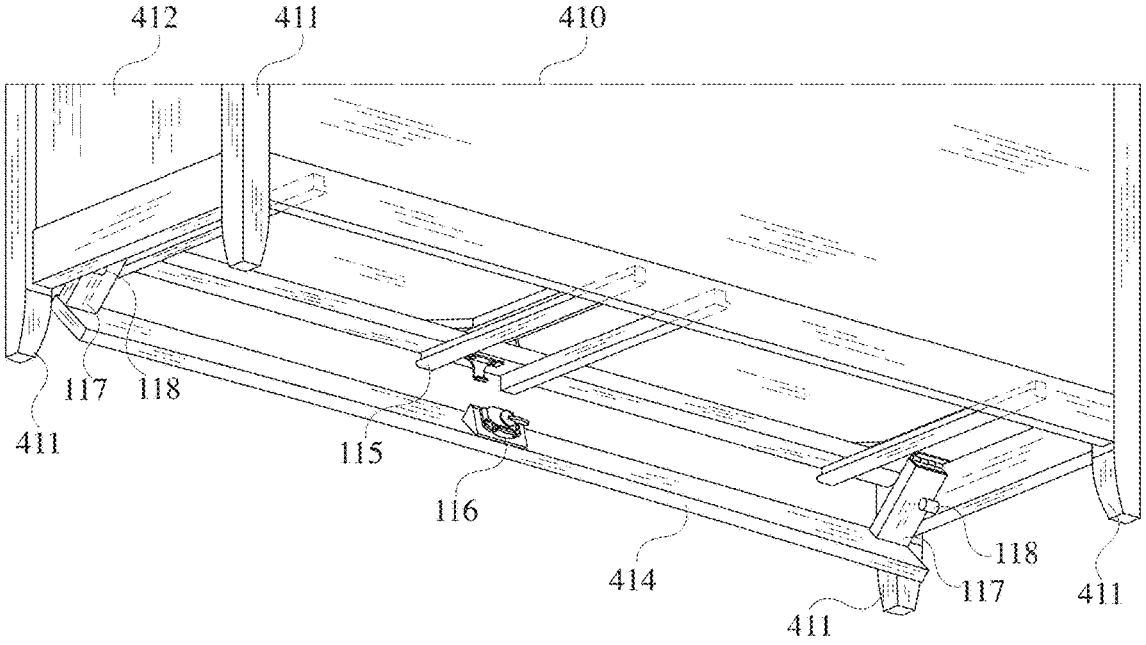
Figure 25:
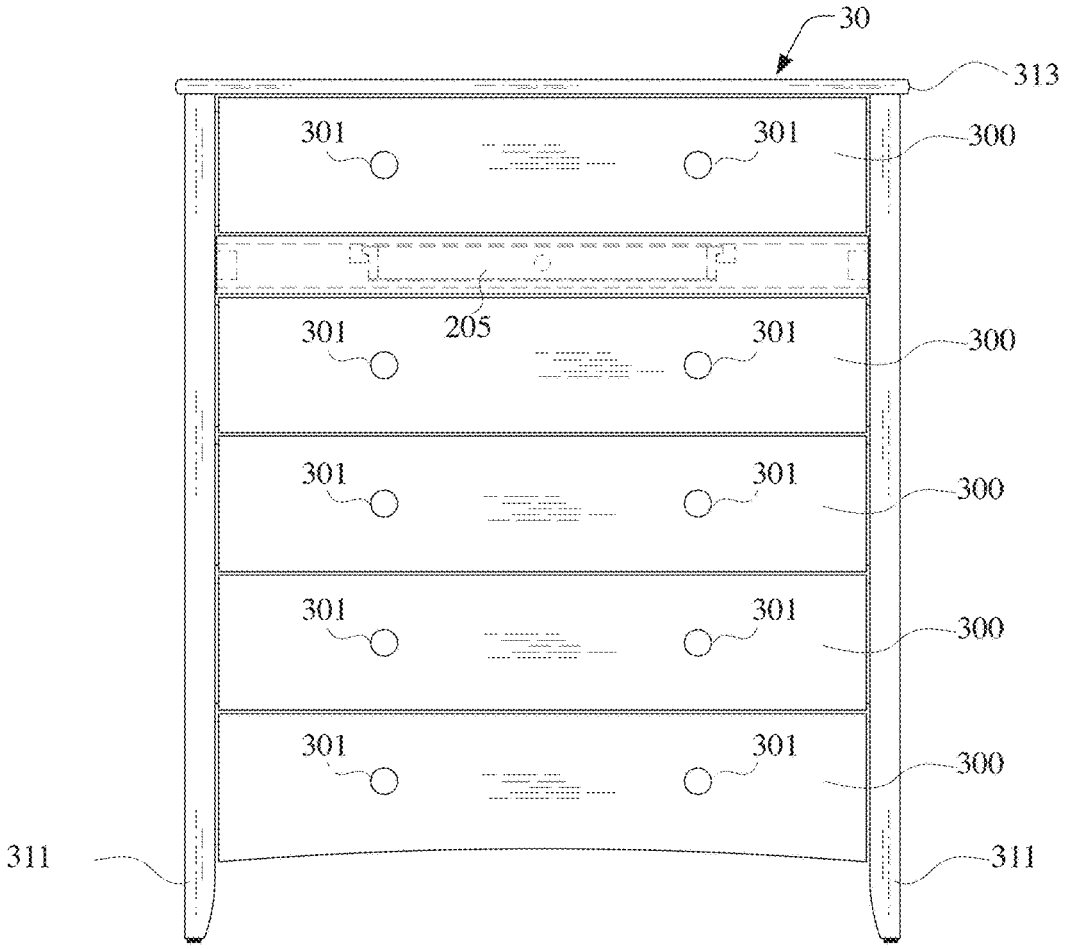
FIGS. 25 to 29 illustrate a furniture apparatus including at least one secret and/or hidden container according to other example embodiments.
Figure 26:
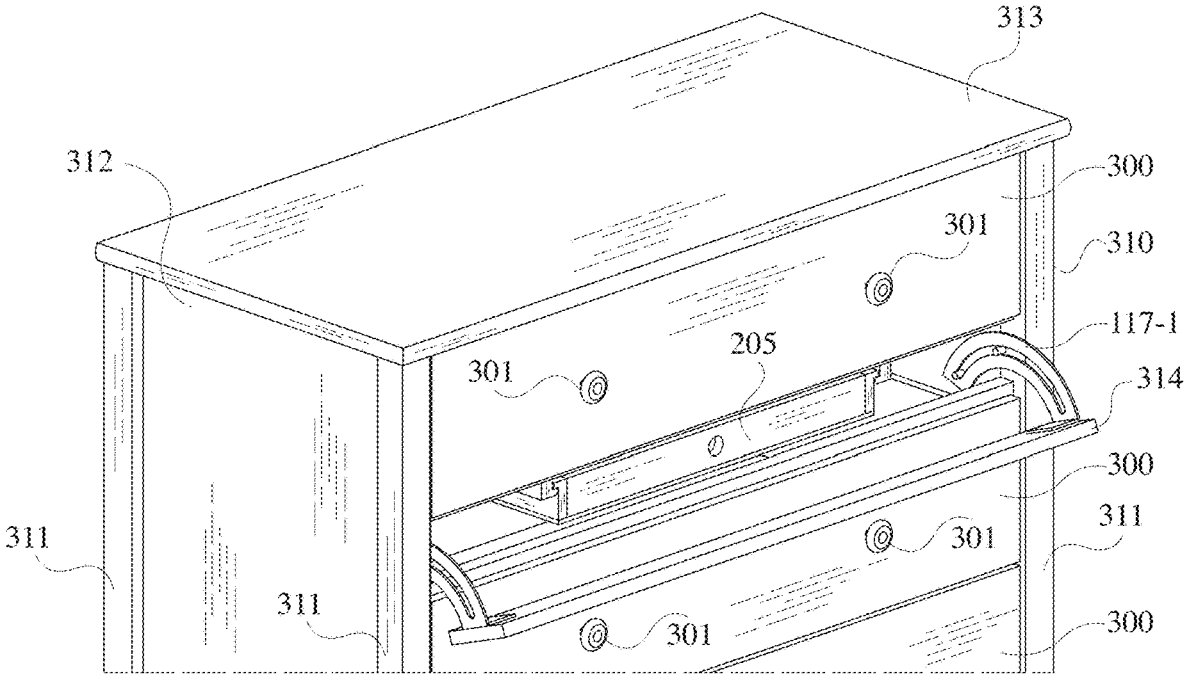
Figure 27:
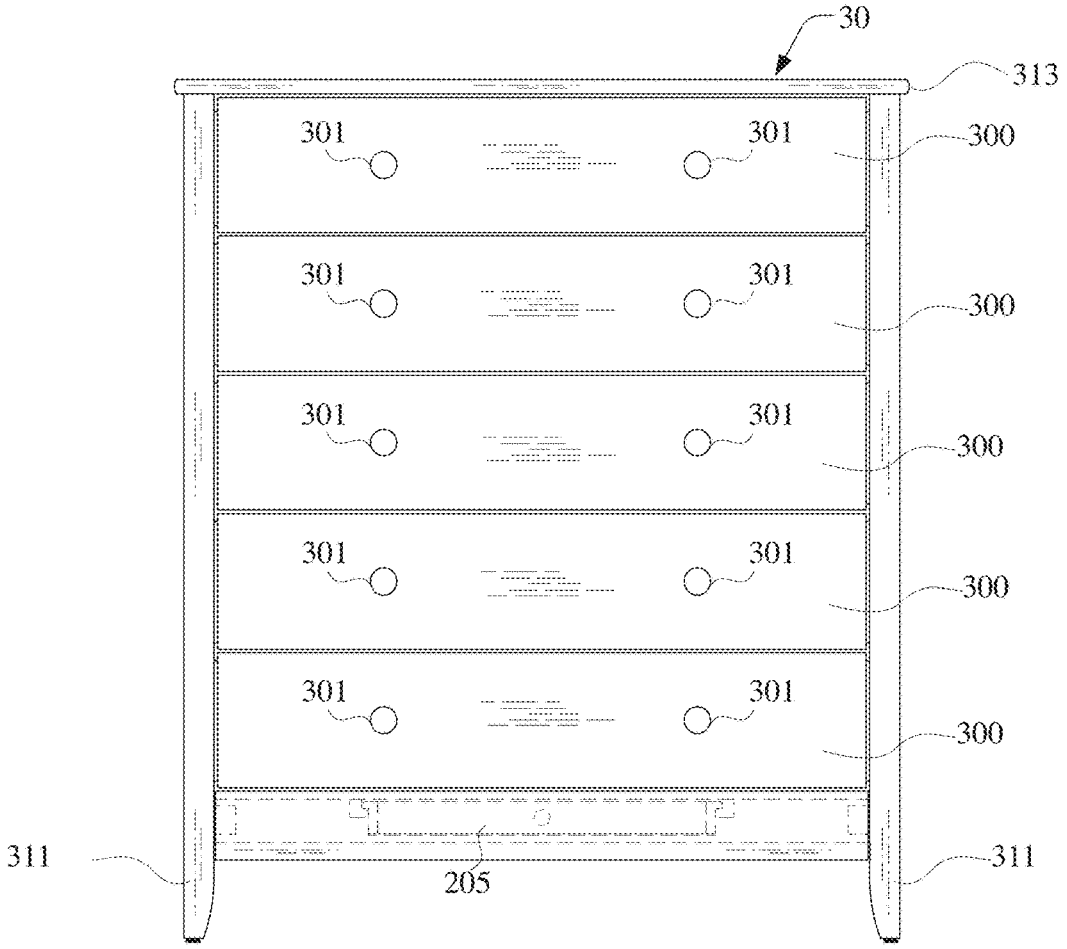
Figure 28:
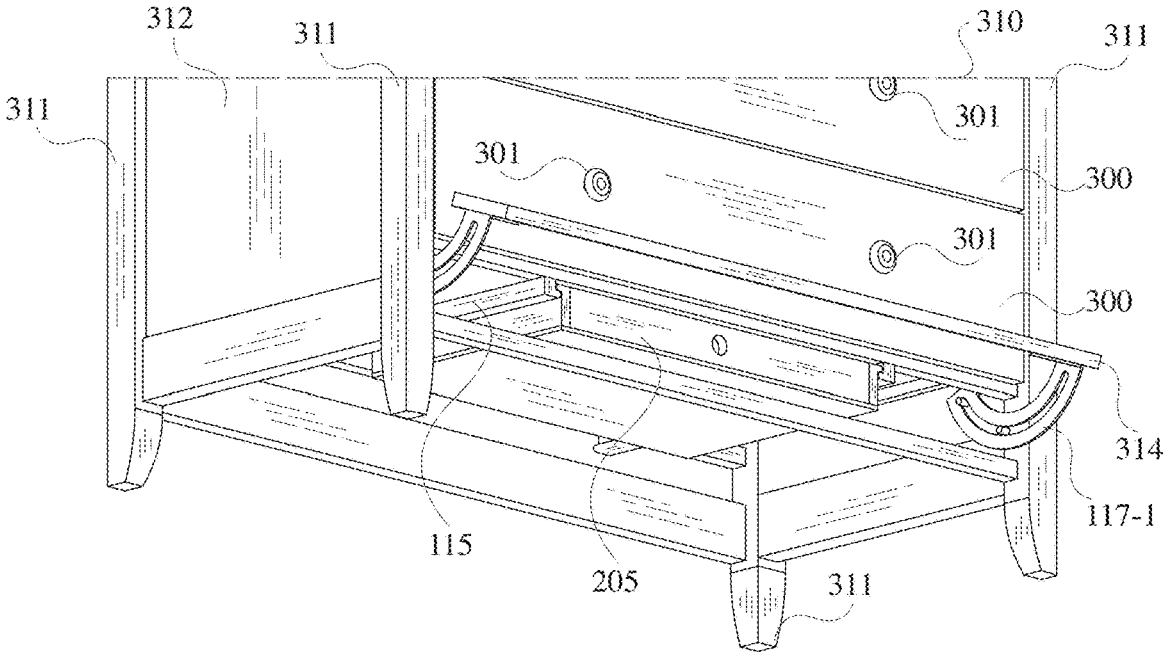
Figure 29:
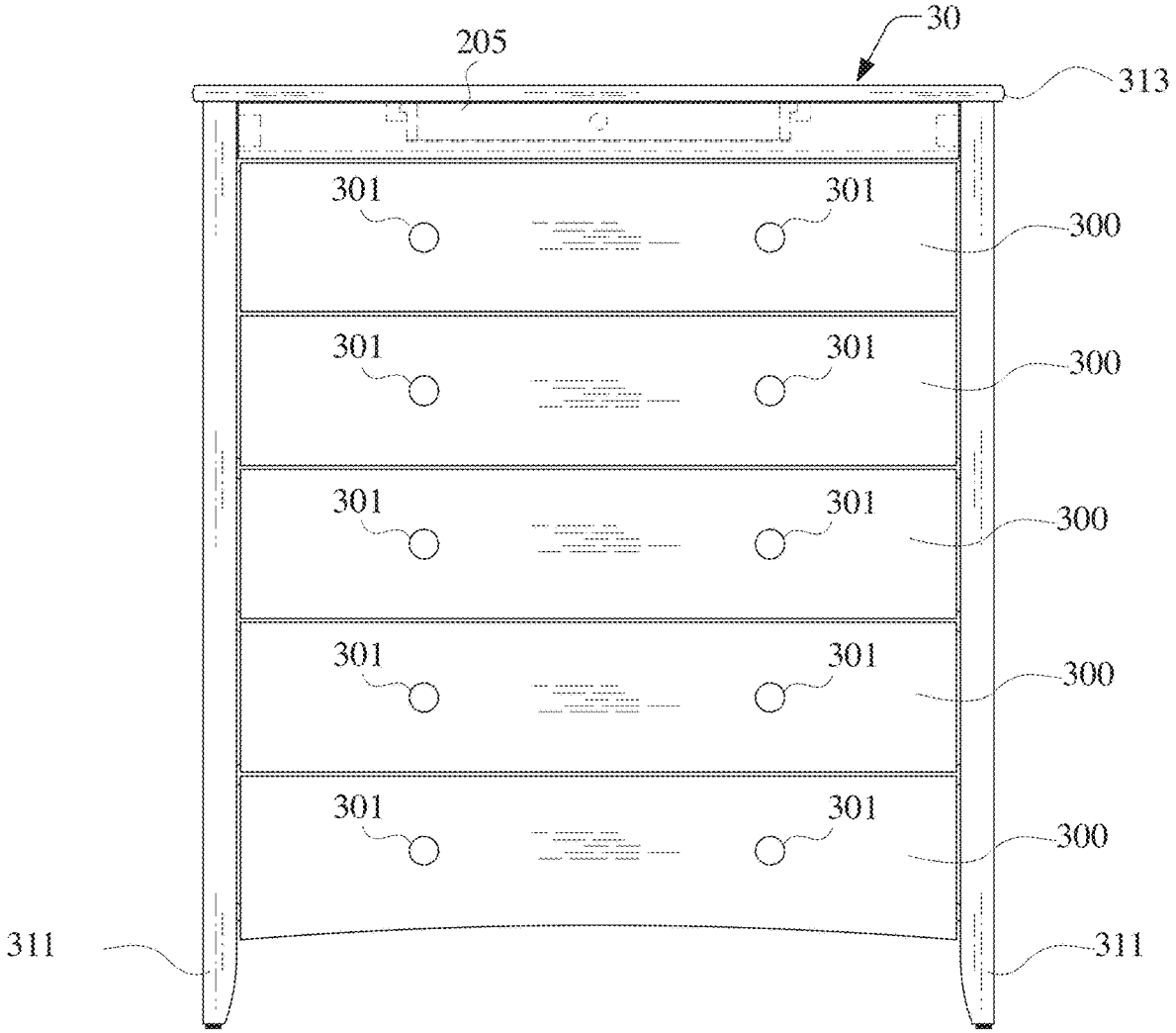

Further, rather than the hidden container 205 being storable in the undercarriage of the frame 10, the furniture apparatus 30 may be configured to store the hidden container 205 in another portion of the frame 10. For example, as illustrated in FIGS. 24 and 25, the movable facade 314 may be between any two of the unhidden containers 300. Further, as illustrated in FIG. 29, the movable facade 314 may between the top surface 313 of the furniture apparatus 30 and an upper most one of the unhidden containers 300.

FIGS. 30 to 33 illustrate a furniture apparatus including at least one secret and/or hidden container according to other example embodiments.

Figure 30:
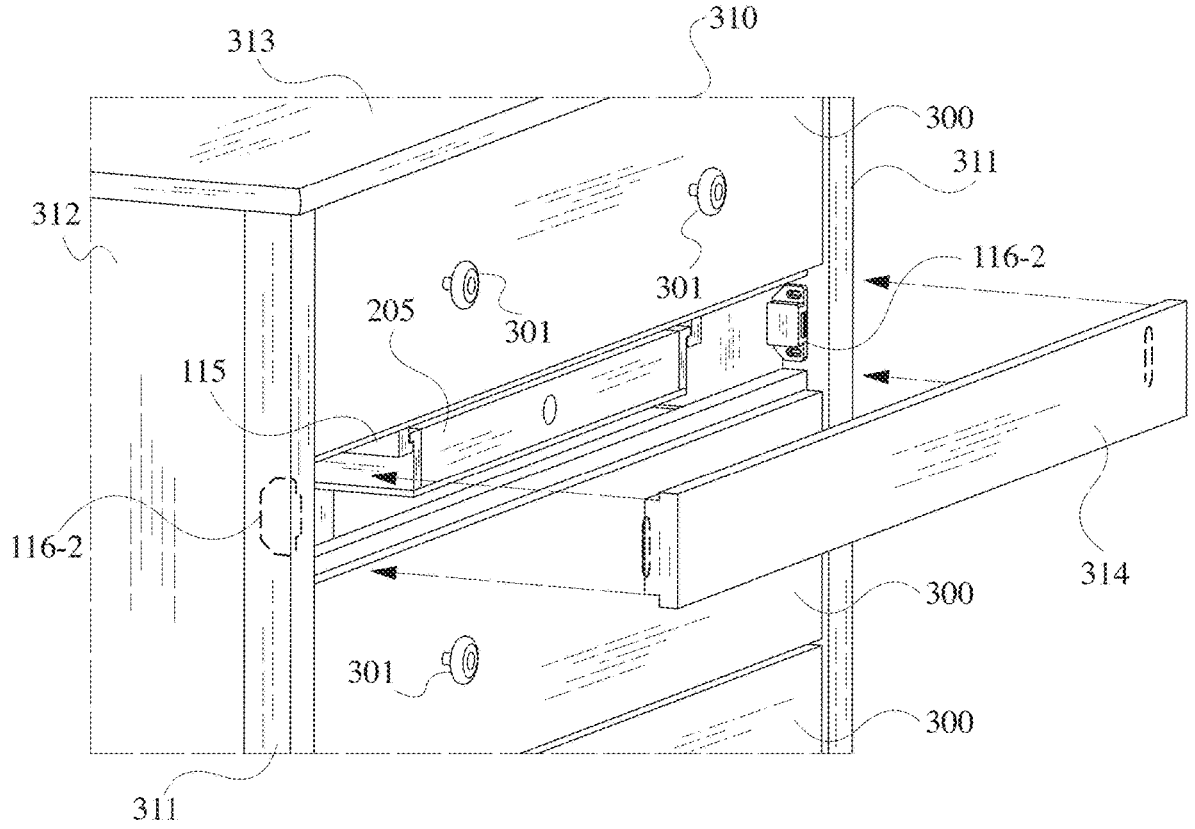
FIGS. 30 to 33 illustrate a furniture apparatus including at least one secret and/or hidden container according to other example embodiments.
Figure 31:
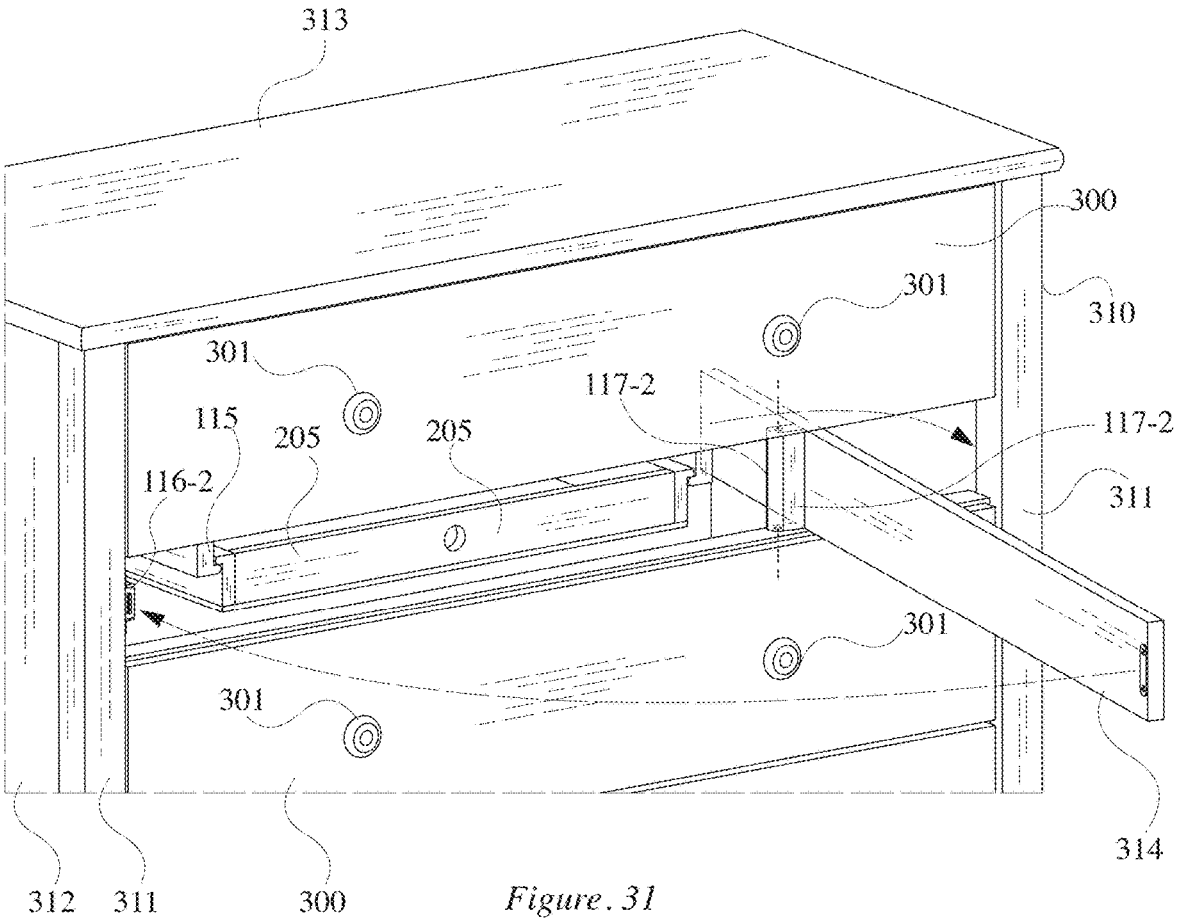
Figure 32:
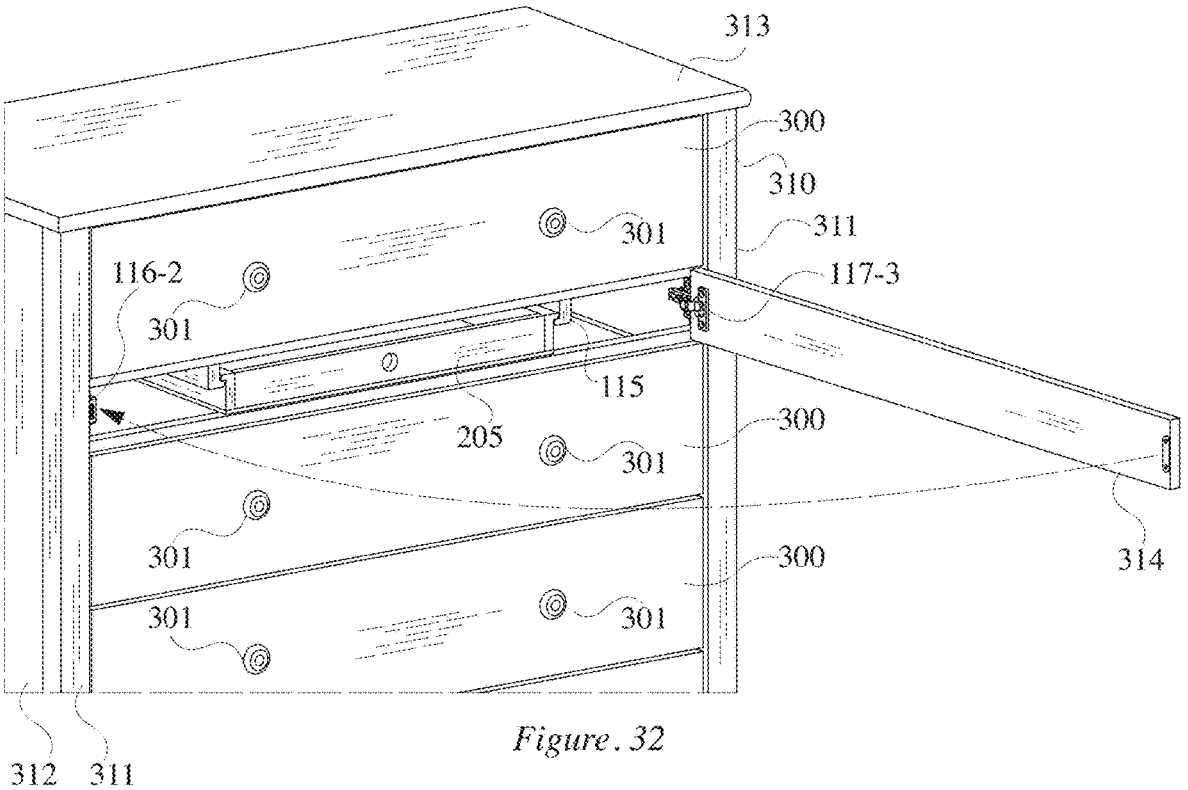

Referring to FIGS. 30 to 33, the movable facade 314 may be removably attachable to the frame 310 via various securing devices other than the securing device 116. For example, as illustrated in FIG. 30, the furniture apparatus 30 may include a pair of magnetic catches 116-2, where each of the magnetic catches 116-2 include magnets attached to opposite sides of one of the frame 310 and the removable facade 314 and armature plates attached to opposite sides of a second one of the frame 310 and the movable facade 314. Further, as illustrated in FIG. 31, the furniture apparatus 30 may include a single magnetic catch 116-2 and a pivoting block 117-2, where the movable facade 314 may selectively pivot about the pivoting block 117-2 to expose the hidden container 205. Further still, as illustrated in FIG. 32, the furniture apparatus 30 may include the single magnetic catch 116-2 attached to first side of the frame 310 and a cabinet hinge 117-3 attached to a second side of the frame 310, where the movable facade 314 may selectively pivot about the cabinet hinge 117 to expose the hidden container 205.

Figure 33:
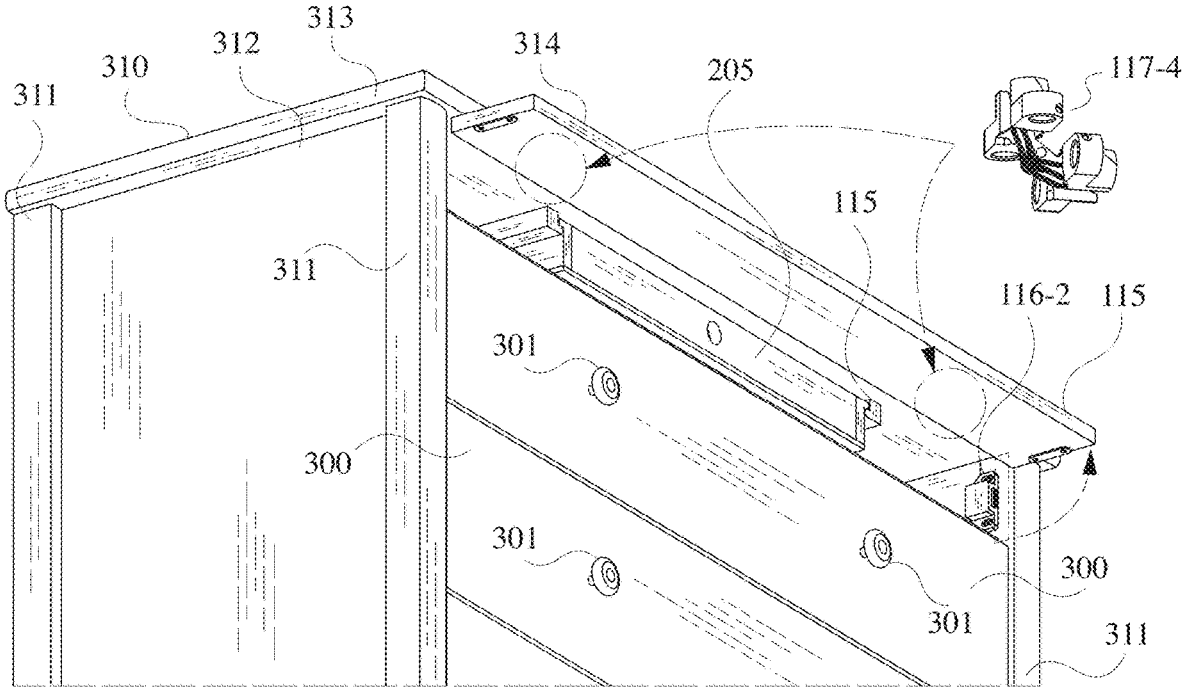

Additionally, as illustrated in FIG. 33, the furniture apparatus 30 may include one or more magnetic catches 116-2 attached to one or more sides of the frame 310 and one or more invisible hinges 117-4, for example SOSS hinges, attached between the movable facade 314 and the frame 310.

Figure 34:
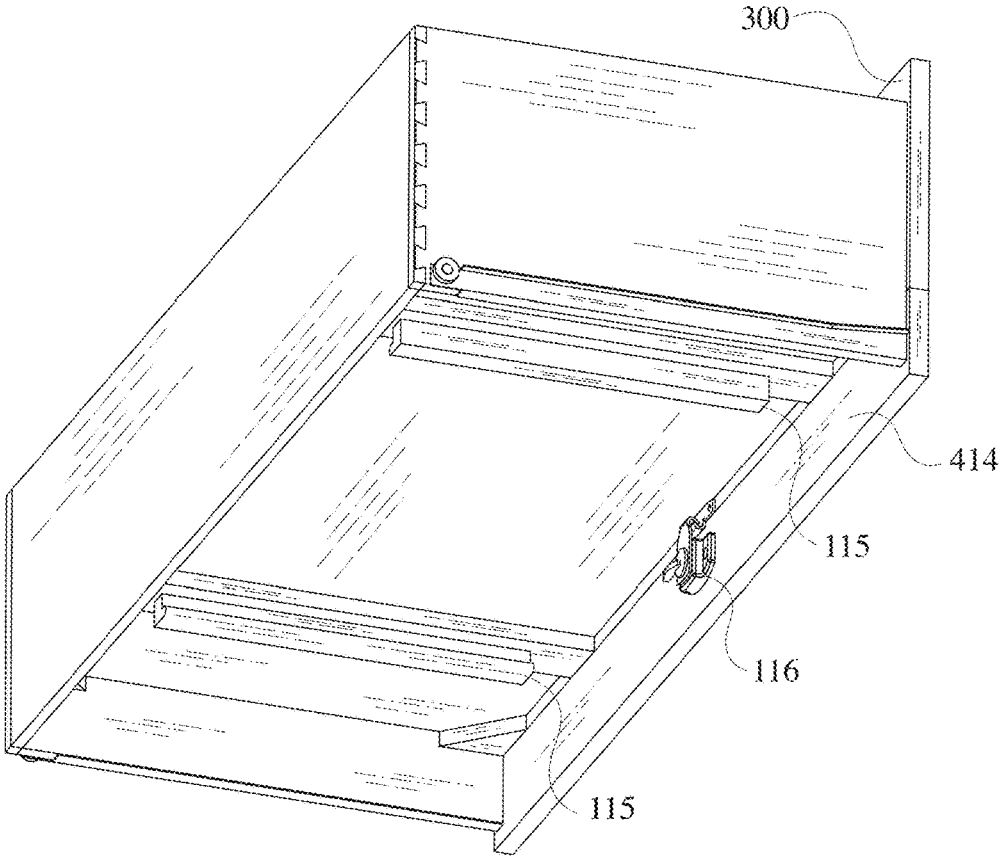
FIGS. 34 to 36 illustrate a drawer of a furniture apparatus including at least one secret and/or hidden container according to another example embodiment.
Figure 35:
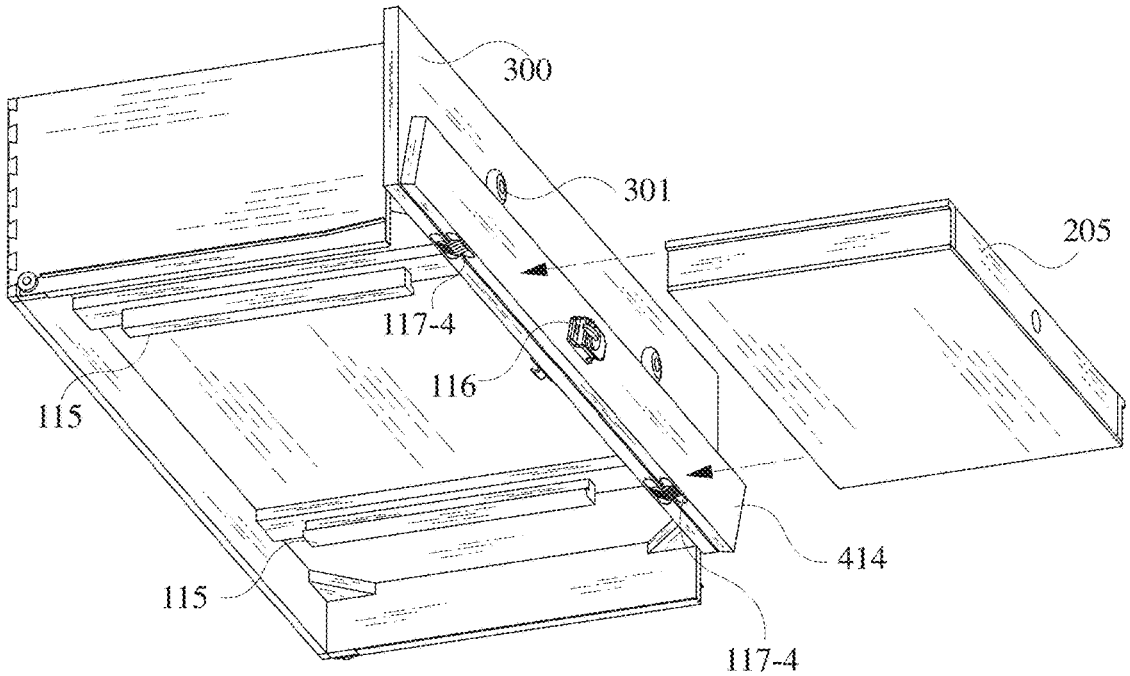
Figure 36:
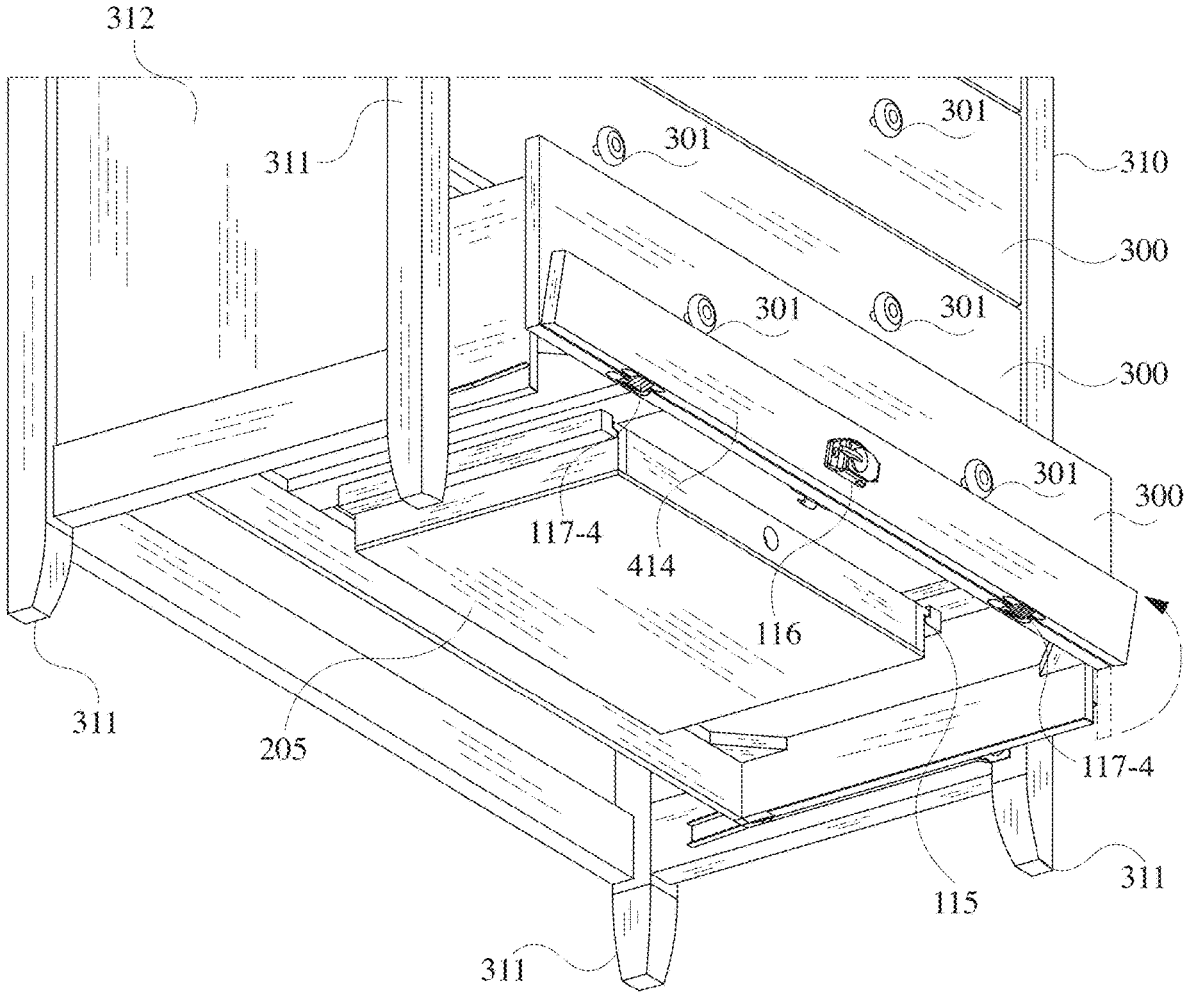

FIGS. 34 to 36 illustrate a drawer of a furniture apparatus including at least one secret and/or hidden container according to another example embodiment.

Referring to FIGS. 34 to 36, rather than be movable with respect to the frame 310 of the furniture apparatus 30, in some example embodiments, a portion of the front of the unhidden container 300 may include a movable facade 414, and the track 115 may be installed on an underside of the unhidden container 300 rather than an underside of the frame 315.

For example, the movable facade 414 may include a portion of the face of the unhidden container 300 below a bottom of the cabinet box. In such a configuration the movable facade 314 may be attached to the unhidden container 300 via the invisible hinges 117-4, for example SOSS hinges, so that the invisible hinges 117-4 are not visible when the movable facade 414 is in the closed state.

Furthermore, according to various embodiments, a furniture object that does not include the hidden container 215 may be converted into a furniture apparatus according to example embodiments by installing a movable facade thereto that is able to transition between a closed state and an open state, and attaching the hidden container thereto such that the hidden container is hidden by the movable facade when the movable facade is in the closed state.

The description of the disclosure is merely example in nature and, thus, variations that do not depart from the gist of the disclosure are intended to be within the scope of the disclosure. Such variations are not to be regarded as a departure from the spirit and scope of the disclosure.

What is claimed is:

1. A furniture apparatus comprising:

a frame including a plurality of openings;

a plurality of unhidden containers each forming an enclosure, the plurality of unhidden containers configured to be received by corresponding ones of the plurality of openings in the frame;

a hidden container configured to rest on a set of support ledges attached to the frame; and a movable facade configured to transition, without removing any of the plurality of unhidden containers, from a closed state to an open state, the closed state being a state in which the movable facade conceals the hidden container from view when the hidden container is installed within the furniture apparatus and the transition from the closed state to the open state exposing the hidden container installed within the furniture apparatus, the movable facade being a frame rail such that, during the transition of the movable facade from the closed state to the open state, the movable facade is configured to perform a non-linear movement different from a linear movement associated with an opening of any of the plurality of unhidden containers, wherein the frame rail that is the movable facade is one or more of (i) between a top surface of the furniture apparatus and an uppermost one of the plurality of unhidden containers such that the movable facade is adjacent to the top surface, (ii) between two adjacent ones of the plurality of unhidden containers and (iii) below a lowermost one of the plurality of unhidden containers.

2. The furniture apparatus of claim 1, wherein the movable facade is configured to transition between the open state and the closed state such that each of the plurality of unhidden containers are visible when the movable facade is in each of the open state and the closed state.

3. The furniture apparatus of claim 1, wherein the hidden container includes an enclosure that is hidden from view when the movable facade is in the closed state.

4. The furniture apparatus of claim 1, wherein the hidden container is configured to be drawn out horizontally in a first direction from the frame when the movable facade is in the open state.

5. The furniture apparatus of claim 1, wherein the set of support ledges includes a sliding mechanism configured to allow the hidden container to slide horizontally.

6. The furniture apparatus of claim 1, wherein the hidden container includes one or more protruding members protruding from a body of the hidden container, the hidden container configured to selectively rest on the set of support ledges via the one or more protruding members.

7. The furniture apparatus of claim 1, further comprising:

a securing device configured to selectively secure the movable facade in the closed state when the securing device is secured, and to allow the movable facade to transition to the open state when the securing device is unsecured.

8. The furniture apparatus of claim 1, further comprising:

a hinge configured to facilitate the non-linear movement of the movable facade.

9. The furniture apparatus of claim 1, wherein the non-linear movement of the movable facade is a pivoting of the movable facade.

10. A furniture apparatus comprising:

a frame including a plurality of openings;

a plurality of unhidden containers each forming an enclosure, the plurality of unhidden containers configured to be received by corresponding ones of the plurality of openings in the frame;

a hidden container configured to rest on a set of support ledges attached to the frame; and a movable facade configured to transition, without removing any of the plurality of unhidden containers, from a closed state to an open state, the closed state being a state in which the movable facade conceals the hidden container from view when the hidden container is installed within the furniture apparatus and the transition from the closed state to the open state exposing the hidden container installed within the furniture apparatus, the movable facade being a frame rail such that, during the transition of the movable facade from the closed state to the open state, the movable facade is configured to perform a non-linear movement different from a linear movement associated with an opening of any of the plurality of unhidden containers, wherein the frame includes four legs at respective corners of the frame, the four legs extending upwards to form vertical support posts for the frame, and wherein the movable facade that is the frame rail extends between a pair of legs among the four legs that form the vertical support posts.

11. The furniture apparatus of claim 10, wherein the frame rail that is the movable facade is movable with respect to at least one of the pair of legs.

12. A furniture apparatus comprising:

a frame including a plurality of openings;

a plurality of unhidden containers each forming an enclosure, the plurality of unhidden containers configured to be received by corresponding ones of the plurality of openings in the frame;

a hidden container configured to rest on a set of support ledges attached to the frame; and a movable facade configured to transition, without removing any of the plurality of unhidden containers, from a closed state to an open state, the closed state being a state in which the movable facade conceals the hidden container from view when the hidden container is installed within the furniture apparatus and the transition from the closed state to the open state exposing the hidden container installed within the furniture apparatus, the movable facade being a frame rail such that, during the transition of the movable facade from the closed state to the open state, the movable facade is configured to perform a non-linear movement different from a linear movement associated with an opening of any of the plurality of unhidden containers, wherein the hidden container is directly behind and on a same horizontal plane as the movable facade when the movable facade is the closed state.

* * * * *